US011180235B2

(12) United States Patent
Wiatrowski

(10) Patent No.: US 11,180,235 B2
(45) Date of Patent: Nov. 23, 2021

(54) STERN AND SWIVEL BRACKET ASSEMBLY FOR MOUNTING A DRIVE UNIT TO A WATERCRAFT

(71) Applicant: BRP US INC., Sturtevant, WI (US)

(72) Inventor: Darrell Wiatrowski, Libertyville, IL (US)

(73) Assignee: BRP US INC.

( * ) Notice: Subject to any disclaimer, the term of this patent is extended or adjusted under 35 U.S.C. 154(b) by 219 days.

(21) Appl. No.: 16/263,440

(22) Filed: Jan. 31, 2019

(65) Prior Publication Data

US 2019/0233073 A1 Aug. 1, 2019

Related U.S. Application Data

(60) Provisional application No. 62/624,361, filed on Jan. 31, 2018.

(51) Int. Cl.
*B63H 20/02* (2006.01)
*B63H 20/08* (2006.01)

(52) U.S. Cl.
CPC ..... *B63H 20/02* (2013.01); *B63H 20/08* (2013.01)

(58) Field of Classification Search
USPC ..... 248/640, 641, 642, 643; 440/61 T, 61 D, 440/61 F
See application file for complete search history.

(56) References Cited

U.S. PATENT DOCUMENTS 6,146,220 A * 11/2000 Alby ..... B63H 20/08 248/642
6,715,438 B1 4/2004 Hundertmark
7,244,152 B1 * 7/2007 Uppgard ..... B63H 20/06 440/53
7,335,073 B1 * 2/2008 Christian ..... B63H 20/36 248/642
8,377,266 B2 * 2/2013 Kagawa ..... B63H 20/10 204/196.37
9,499,247 B1 11/2016 Wiatrowski et al.
9,540,088 B1 * 1/2017 French ..... B63H 25/42
(Continued)

OTHER PUBLICATIONS

Seastar Solutions, Seastar Power Assist, Brochure, 2014, www.seastarsolutions.com, 6 pages.
(Continued)

*Primary Examiner* — Alfred J Wujciak
(74) *Attorney, Agent, or Firm* — BCF LLP

(57) ABSTRACT

A stern and swivel bracket assembly for mounting a drive unit to a watercraft has a stern bracket having first and second laterally spaced portions, a swivel bracket pivotally connected to the stern bracket about a tilt/trim axis, and a hydraulic linear tilt-trim actuator operatively connected between the stern and swivel brackets. The swivel bracket includes a hydraulic steering actuator, and defines first and second hydraulic steer ports facing outward in a first lateral direction. The swivel bracket further includes at least one drive unit mounting bracket connected to the hydraulic steering actuator for connecting the drive unit to the swivel bracket. The hydraulic linear tilt-trim actuator is located laterally between the first and second portions of the stern bracket, and defines trim-up and trim-down hydraulic ports facing outward in a second lateral direction opposite the first lateral direction.

14 Claims, 21 Drawing Sheets

(56) References Cited

U.S. PATENT DOCUMENTS

| | | | | |
|---|---|---|---|---|
| 10,472,039 | B2 | 11/2019 | McGinley et al. | |
| 2009/0170384 | A1* | 7/2009 | Balogh | B63H 20/08 440/53 |
| 2010/0285706 | A1* | 11/2010 | Meguro | F15B 15/1433 440/61 T |
| 2011/0195620 | A1* | 8/2011 | Davis | B63H 20/32 440/75 |
| 2012/0077395 | A1* | 3/2012 | Ooishi | B63H 20/08 440/65 |
| 2014/0199898 | A1* | 7/2014 | Takase | B63H 20/02 440/63 |
| 2019/0233073 | A1* | 8/2019 | Wiatrowski | B63H 20/02 |
| 2019/0233074 | A1* | 8/2019 | Wiatrowski | B63H 20/06 |

OTHER PUBLICATIONS

Seastar Solutions, Optimus 360 Joystick, Brochure, Mar. 2014, Issue No. EPS2, www.seastarsolutions.com, 2 pages.

* cited by examiner

STERN AND SWIVEL BRACKET ASSEMBLY FOR MOUNTING A DRIVE UNIT TO A WATERCRAFT

CROSS-REFERENCE TO RELATED APPLICATION

The present application claims priority to U.S. Provisional Patent Application Ser. No. 62/624,361, filed Jan. 31, 2018, entitled "Stern and Swivel Bracket Assembly for Mounting a Drive Unit to a Watercraft", which is incorporated herein by reference in its entirety.

TECHNICAL FIELD

The present technology relates to stern and swivel bracket assemblies for mounting a drive unit to a watercraft.

BACKGROUND

A marine outboard engine generally comprises a bracket assembly that connects the drive unit of the marine outboard engine to the transom of a boat. The drive unit includes the internal combustion engine and the propeller. The marine outboard engine is typically designed so that the steering angle and the tilt/trim angles of the drive unit relative to the boat can be adjusted and modified as desired. The bracket assembly typically includes a swivel bracket carrying the drive unit for pivotal movement about a steering axis and a stern bracket supporting the swivel bracket and the drive unit for pivotal movement about a tilt/trim axis extending generally horizontally. The stern bracket is connected to the transom of the boat.

Some marine outboard engines are provided with a hydraulic actuator connected between the stern and swivel bracket assembly for pivoting the swivel bracket about the tilt/trim axis to adjust the running (tilt) angle of the drive unit when underway and to lift the lower portion of the marine outboard engine above the water level when not in operation. Some marine outboard engines are provided with a distinct hydraulic actuator for adjusting the running angle. Some marine outboard engines are also provided with a hydraulic actuator connected between the swivel bracket and the drive unit for pivoting the drive unit about the steering axis in order to steer the boat.

Different types of hydraulic steering systems exist on watercrafts, whether manual or powered hydraulic steering systems, and these hydraulic steering systems can be actuated via, for example, a tiller, a helm assembly or a joystick. Typically, the hydraulic actuator pivoting the drive unit about the steering axis and the swivel bracket are designed to accommodate one type of steering system.

The pumps, motors, manifolds and reservoirs of a conventional power steering system are typically provided inside the boat. This takes up valuable space inside the boat and requires the routing of hoses between the pumps and actuators, which can be cumbersome. In some known bracket assemblies, such as the one described in U.S. Pat. No. 9,499,247 B1, components of the hydraulic power steering system are mounted to the bracket.

There is a desire for a stern and swivel bracket assembly that could accommodate the components of different types of hydraulic steering systems.

SUMMARY

It is an object of the present technology to ameliorate at least some of the inconveniences present in the prior art.

According to one aspect of the present technology, there is provided a stern and swivel bracket assembly for mounting a drive unit to a watercraft. The stern and swivel bracket assembly has a stern bracket having first and second laterally spaced portions and a swivel bracket pivotally connected to the stern bracket about a tilt-trim axis. The swivel bracket includes a hydraulic steering actuator located laterally between the first and second portions of the stern bracket when the drive unit is in a trimmed-down position. The swivel bracket defines first and second hydraulic steer ports facing outward in a first lateral direction, the first and second hydraulic steer ports being fluidly connected to the hydraulic steering actuator through passages formed at least partially within the swivel bracket for supplying hydraulic fluid to the hydraulic steering actuator. The swivel bracket also includes at least one drive unit mounting bracket connected to the hydraulic steering actuator for connecting the drive unit to the swivel bracket. The at least one drive unit mounting bracket is pivotable with respect to the swivel bracket about a steering axis. The stern and swivel bracket assembly further has a hydraulic linear tilt-trim actuator operatively connected between the stern and swivel brackets. The hydraulic linear tilt-trim actuator is located laterally between the first and second portions of the stern bracket. The hydraulic linear tilt-trim actuator is disposed forward of the hydraulic steering actuator when the drive unit is in the trimmed-down position. The hydraulic linear tilt-trim actuator defines trim-up and trim-down hydraulic ports facing outward in a second lateral direction opposite the first lateral direction.

In some implementations, the stern and swivel bracket assembly further includes a hydraulic tilt-trim pump assembly mounted to the hydraulic linear tilt-trim actuator and located laterally between the first portion of the stern bracket and the hydraulic linear tilt-trim actuator. The hydraulic tilt-trim pump assembly defines trim-up and trim-down hydraulic ports that are fluidly connected to the trim-up and trim-down hydraulic ports of the hydraulic linear tilt-trim actuator for supplying hydraulic fluid to the hydraulic linear tilt-trim actuator.

In some implementations, the hydraulic tilt-trim pump assembly includes a motor, a pump operatively connected to the motor, and a manifold fluidly connected to the pump, and the trim-up and trim-down hydraulic ports of the hydraulic tilt-trim pump assembly are fluidly connected to the manifold.

In some implementations, the hydraulic steering actuator is a rotary steering actuator.

In some implementations, the at least one drive unit mounting bracket includes upper and lower drive unit mounting brackets, and the hydraulic steering actuator extends between the upper and lower drive unit mounting brackets.

In some implementations, the hydraulic steering actuator and the hydraulic linear tilt-trim actuator are laterally aligned when the drive unit is in a trimmed-down position.

In some implementations, the hydraulic steering actuator and the hydraulic linear tilt-trim actuator are laterally aligned along a lateral center of the stern and swivel bracket assembly.

In some implementations, the stern and swivel bracket assembly further includes a hydraulic steering system including a hydraulic steering component mounted to the swivel bracket and being located laterally between the hydraulic linear tilt-trim actuator and the second portion of the stern bracket. The hydraulic steering component defines first and second hydraulic steer ports fluidly connected to the first and second hydraulic steer ports of the swivel bracket for supplying hydraulic fluid to the hydraulic steering actuator.

In some implementations, the hydraulic steering component includes a motor, a pump operatively connected to the motor, and a manifold fluidly connected to the pump, and the first and second hydraulic steer ports of the hydraulic steering component are fluidly connected to the manifold.

In some implementations, the hydraulic steering component further has fittings for receiving port and starboard helm hoses, and the fittings are fluidly connected to the manifold.

In some implementations, the hydraulic steering component further includes a reservoir fluidly connected to the manifold.

In some implementations, the hydraulic steering actuator is at least partially integrally formed with the swivel bracket.

According to another aspect of the present technology, there is provided a marine outboard engine including the stern and swivel bracket assembly as described above, and the drive unit connected to the swivel bracket.

According to another aspect of the present technology, there is provided a watercraft including the marine outboard engine described above.

According to yet another aspect of the present technology, there is provided a stern and swivel bracket assembly for mounting a drive unit to a watercraft including a stern bracket having first and second laterally spaced portions, and a swivel bracket pivotally connected to the stern bracket about a tilt-trim axis. The swivel bracket includes a hydraulic steering actuator located laterally between the first and second portions of the stern bracket when the drive unit is in a trimmed-down position. The swivel bracket defines first and second hydraulic steer ports facing laterally outward of the swivel bracket toward the first portion of the stern bracket, the first and second hydraulic steer ports being fluidly connected to the hydraulic steering actuator through passages formed at least partially within the swivel bracket for supplying hydraulic fluid to the hydraulic steering actuator. The swivel bracket further includes at least one drive unit mounting bracket connected to the hydraulic steering actuator for connecting the drive unit to the swivel bracket. The at least one drive unit mounting bracket is pivotable with respect to the swivel bracket about a steering axis. The swivel bracket also includes swivel bracket mounts defined at least in part by the swivel bracket. The stern and swivel bracket assembly further includes a hydraulic steering component of a hydraulic steering system mounted to the swivel bracket mounts of the swivel bracket. The hydraulic steering component has first and second hydraulic steer ports fluidly connected to the first and second hydraulic steer ports of the swivel bracket when mounted to the swivel bracket mounts. The hydraulic steering component is selected from a group of hydraulic steering components, each member of the group of hydraulic steering component having component mounts corresponding to the swivel bracket mounts, and each member of the group of hydraulic steering component corresponding to a different type of hydraulic steering system.

In some implementations, the swivel bracket mounts are located laterally between the hydraulic steering actuator and the first portion of the stern bracket.

In some implementations, the hydraulic steering component is one of a power steering unit of a helm-actuated power steering system, a power steering unit of a tiller-actuated power steering system, and a power steering unit of a joystick-actuated power steering system.

According to yet another aspect of the present technology, there is provided a stern and swivel bracket assembly for mounting a drive unit to a watercraft. The stern and swivel bracket assembly includes a stern bracket having first and second laterally spaced portions, a swivel bracket pivotally connected to the stern bracket about a tilt-trim axis, a center plane defined along a lateral center of the stern and swivel bracket assembly. The stern and swivel bracket assembly further includes a hydraulic linear tilt-trim actuator operatively connected between the stern and swivel brackets. The hydraulic linear tilt-trim actuator is located laterally between the first and second portions of the stern bracket. The stern and swivel bracket assembly also includes a hydraulic steering actuator located laterally between the first and second portions of the stern bracket and rearward of the hydraulic linear tilt-trim actuator when the drive unit is in the trimmed-down position. The stern and swivel bracket assembly further includes at least one drive unit mounting bracket connected to the hydraulic steering actuator for connecting the drive unit to the swivel bracket. The at least one drive unit mounting bracket is pivotable with respect to the swivel bracket about a steering axis. The stern and swivel bracket assembly also includes a hydraulic tilt-trim pump assembly mounted to the hydraulic linear tilt-trim actuator and located on a first side of the center plane, and a hydraulic steering component mounted to the swivel bracket and located on a second side of the center plane opposite the first side.

In some implementations, the hydraulic tilt-trim pump assembly and the hydraulic steering component are located below the tilt-trim axis.

For the purposes of this application, terms related to spatial orientation such as forward, rearward, left, right, vertical, and horizontal are as they would normally be understood by a driver of a boat sitting thereon in a normal driving position with a marine outboard engine mounted to a transom of the boat.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Should there be any difference in the definitions of term in this application and the definition of these terms in any document included herein by reference, the terms as defined in the present application take precedence.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
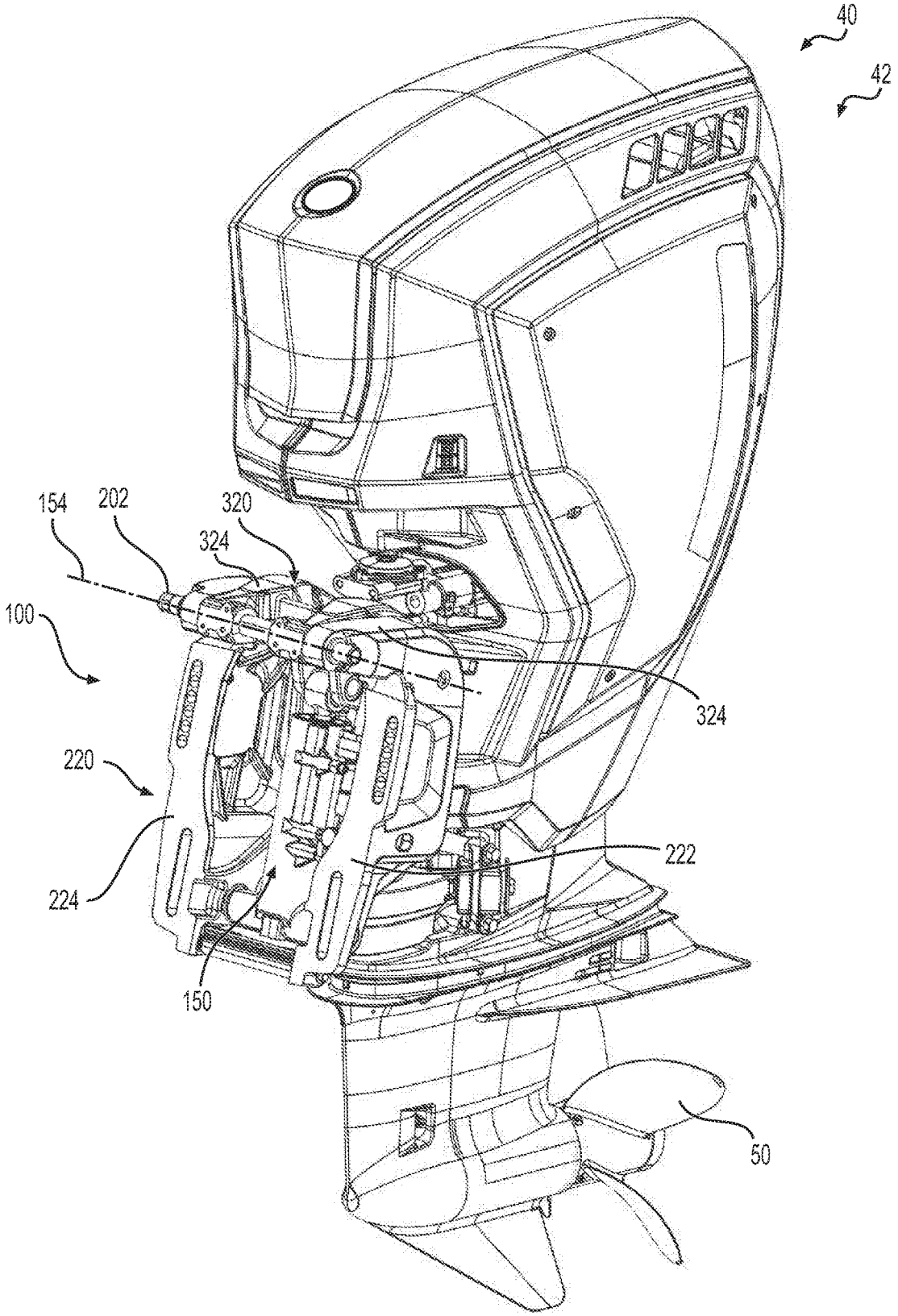
FIG. 1 is a perspective view taken from a front, top, left side of a marine outboard engine having a drive unit and a stern and swivel bracket assembly.
Figure 2:
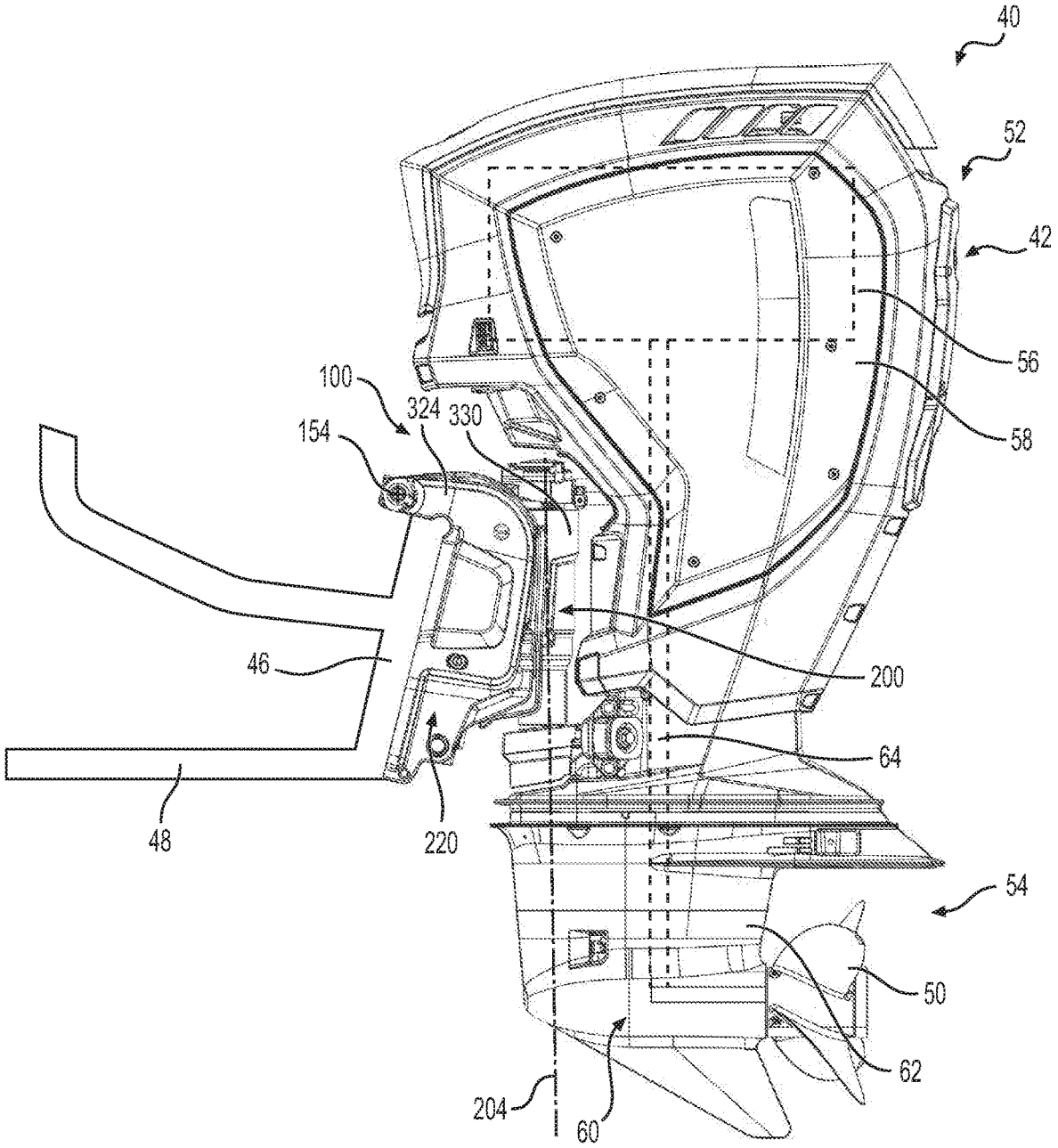
FIG. 2 is a left side elevation view of the marine outboard engine of FIG. 1 mounted in an upright position to a transom of watercraft through the stern and swivel bracket assembly of FIG. 1.

With reference to FIGS. 1 and 2, a marine outboard engine 40, shown in the upright position, includes a drive unit 42 and a stern and swivel bracket assembly 100. The stern and swivel bracket assembly 100 supports the drive unit 42 on a transom 46 of a hull 48 of an associated watercraft (not shown) such that a propeller 50 is in a submerged position with the watercraft resting relative to a surface of a body of water. The drive unit 42 can be trimmed-up and tilted-up (see FIG. 3) or down relative to the hull 48 by a hydraulic linear tilt-trim actuator 150 of the stern and swivel bracket assembly 100 about a tilt/trim axis 154 extending generally horizontally. The drive unit 42 can also be steered left (see FIG. 4) or right relative to the hull 48 by a hydraulic steering actuator 200 of the stern and swivel bracket assembly 100 about a steering axis 204. The steering axis 204 extends generally perpendicularly to the tilt/trim axis 154. When the drive unit 42 is in the upright position as shown in FIG. 2, the steering axis 204 extends generally vertically.

The drive unit 42 includes an upper portion 52 and a lower portion 54. The upper portion 52 includes an engine 56 (schematically shown in dotted lines in FIG. 2) surrounded and protected by a cowling 58. The engine 56 housed within the cowling 58 is an internal combustion engine, such as a two-stroke or four-stroke engine, having cylinders extending horizontally. It is contemplated that other types of engine could be used and that the cylinders could be oriented differently. It is also contemplated that the internal combustion engine 56 could be replaced by an electric motor. The lower portion 54 includes a gear case assembly 60, which includes the propeller 50, and a skeg portion 62, which extends from the upper portion 52 to the gear case assembly 60.

The engine 56 is coupled to a driveshaft 64 (schematically shown in dotted lines in FIG. 2). When the drive unit 42 is in the upright position as shown in FIG. 2, the driveshaft 64 is oriented vertically. It is contemplated that the driveshaft 64 could be oriented differently relative to the engine 56. The driveshaft 64 is coupled to a drive mechanism (not shown), which includes a transmission (not shown) and the propeller 50 mounted on a propeller shaft (not shown). In FIG. 2, the propeller shaft 66 is perpendicular to the driveshaft 64, however it is contemplated that it could be at other angles. The driveshaft 64 and the drive mechanism transfer the power of the engine 56 to the propeller 50 mounted on the rear side of the gear case assembly 60 of the drive unit 42. It is contemplated that the propulsion system of the marine outboard engine 40 could alternatively include a jet propulsion device, turbine or other known propelling device. It is further contemplated that the bladed rotor could alternatively be an impeller. Other known components of an engine assembly are included within the cowling 58, such as a starter motor, an alternator and the exhaust system. As it is believed that these components would be readily recognized by one of ordinary skill in the art, further explanation and description of these components will not be provided herein.

Figure 4:
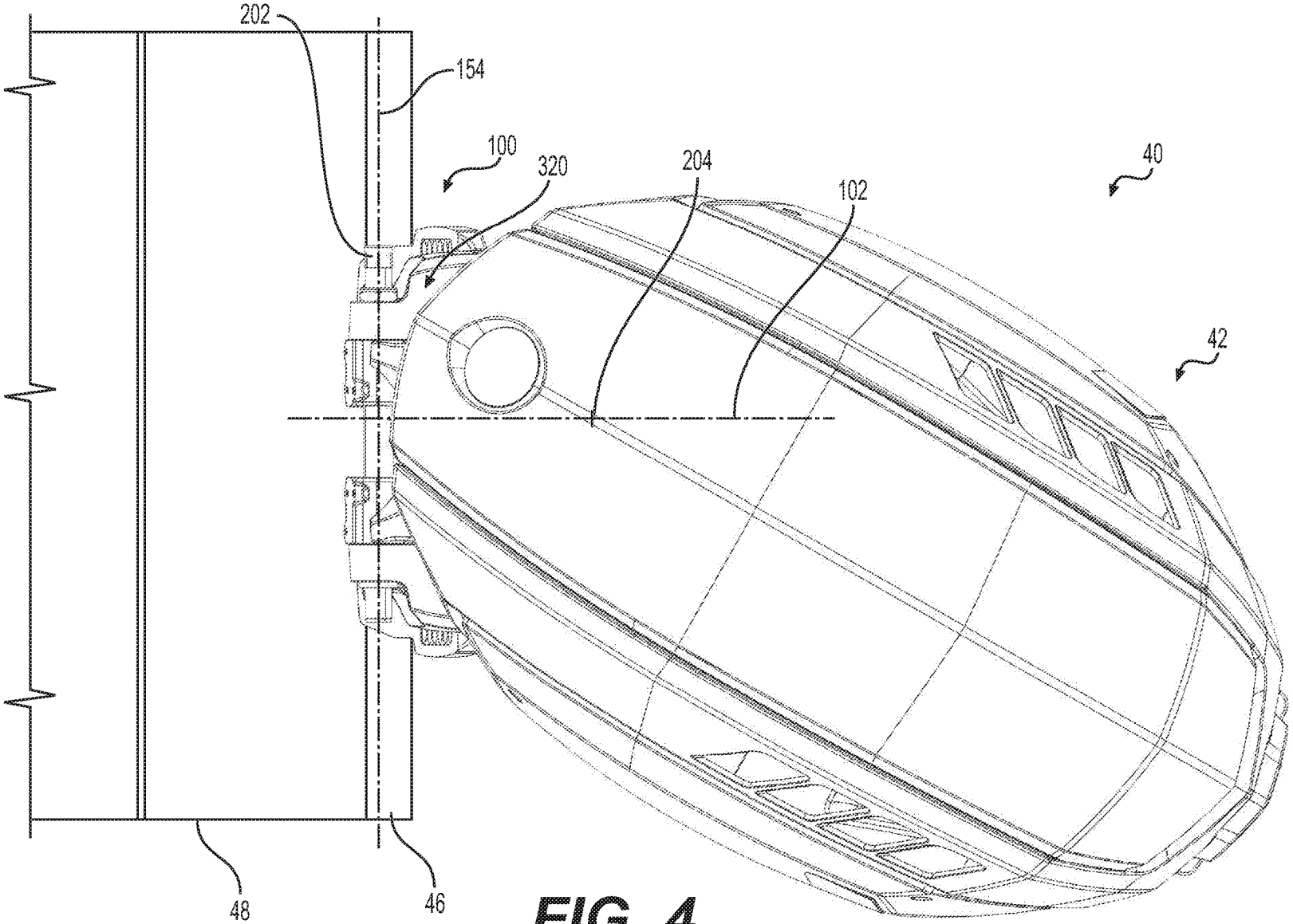
FIG. 4 is a top plan view of the marine outboard engine of FIG. 2 steered to make a left turn.
Figure 5:
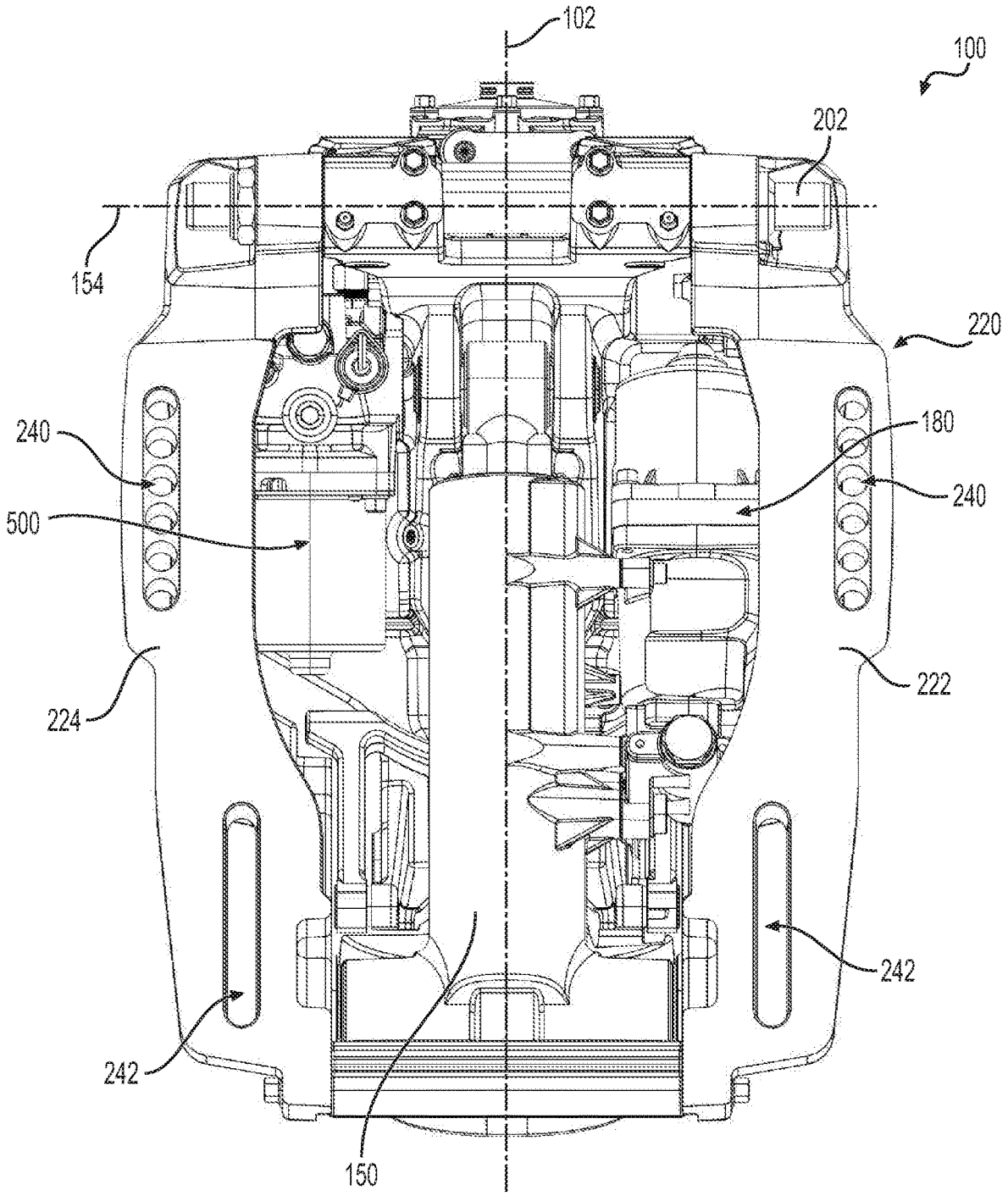
FIG. 5 is a front elevation view of the stern and swivel bracket assembly of FIG. 1, with the swivel bracket in an upright position.
Figure 6:
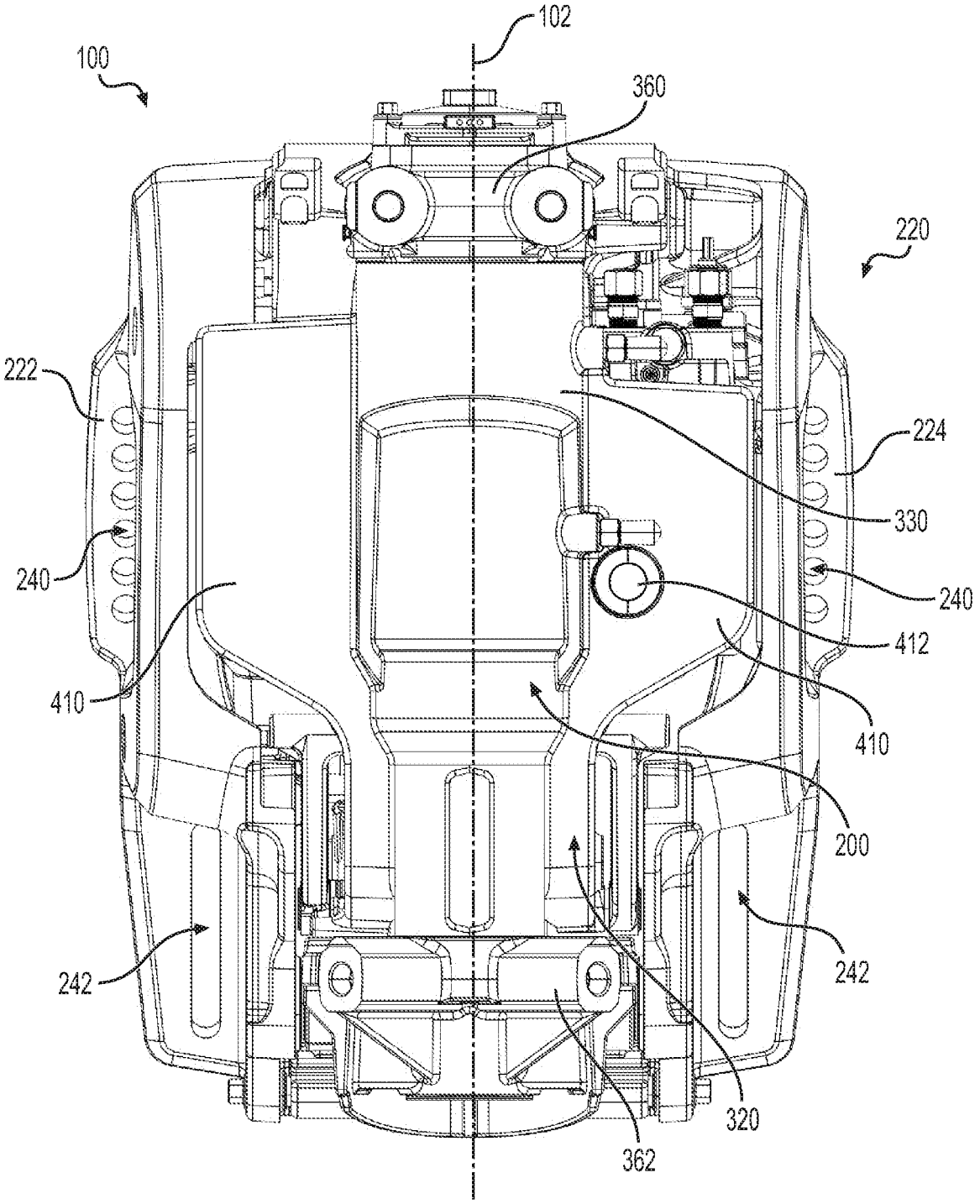
FIG. 6 is a rear elevation view of the stern and swivel bracket assembly of FIG. 5.
Figure 7:
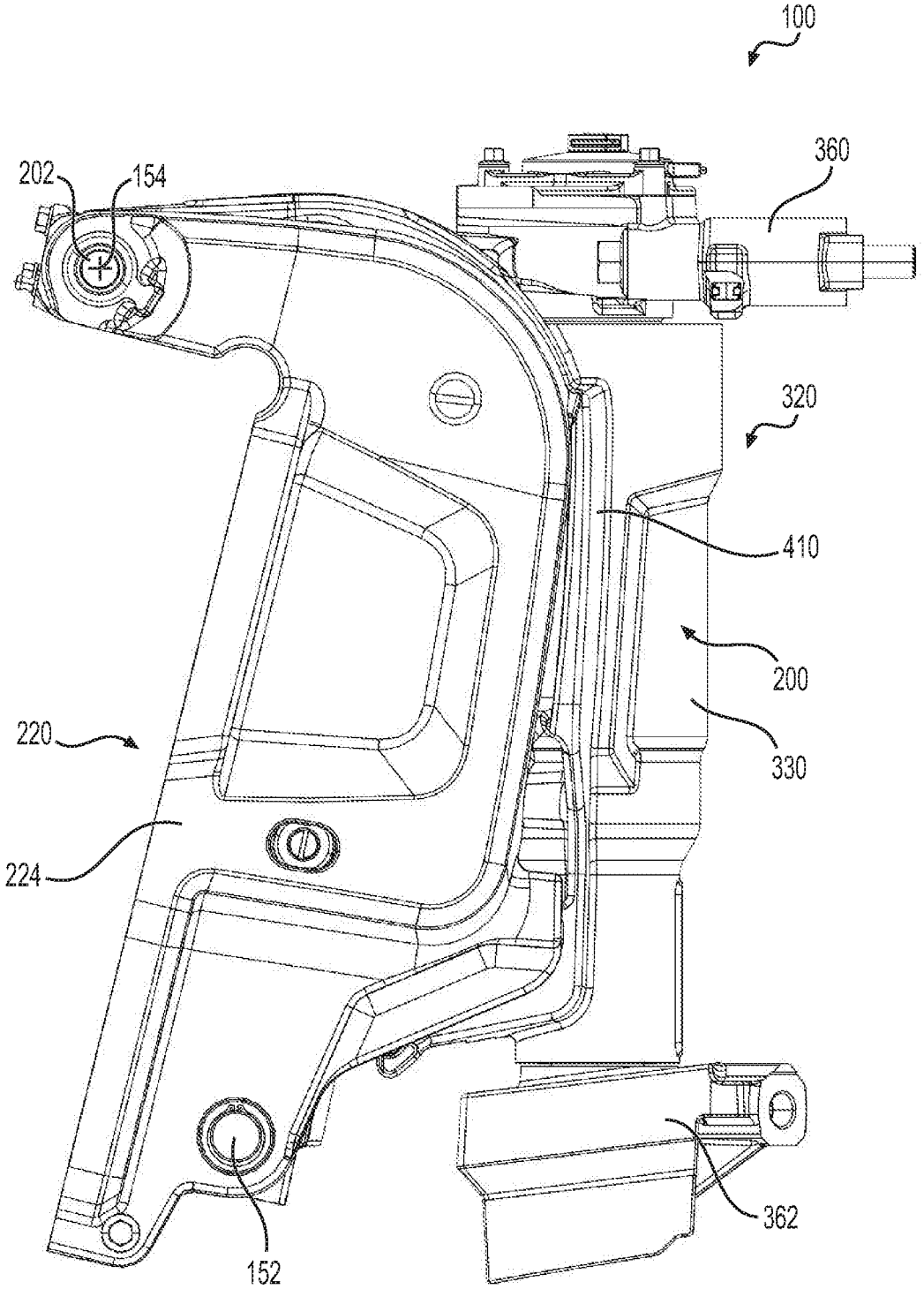
FIG. 7 is a left side elevation view of the stern and swivel bracket assembly of FIG. 5.
Figure 8:
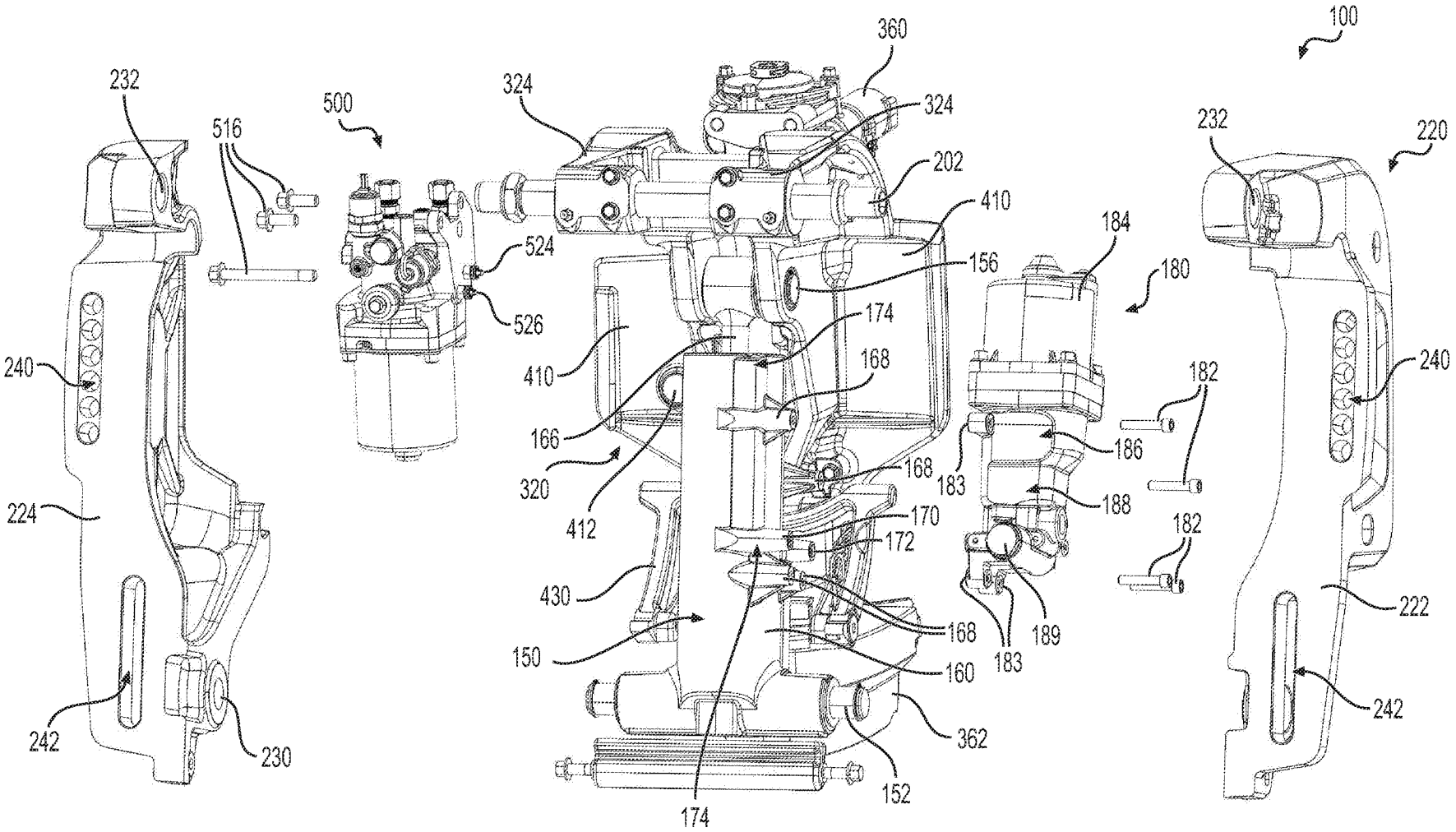
FIG. 8 is an exploded, perspective view taken from a front, top, left side of the stern and swivel bracket assembly of FIG. 5.

Turning now to FIGS. 5 to 12, the stern and swivel bracket assembly 100 will be described in more detail. The stern and swivel bracket assembly 100 includes a stern bracket 220 pivotally connected to a swivel bracket 320 via a tilt axle 202 extending through the stern bracket 220 and the swivel bracket 320. The tilt axle 202 is coaxial with the tilt/trim axis 154. As best shown in FIGS. 1 and 8, the swivel bracket 320 has two forwardly extending arms 324 having apertures defined therethrough, and the tilt axle 202 is received through these apertures. Referring to FIGS. 5 and 6, a center plane 102 is defined along a lateral center of the stern and swivel bracket assembly 100. The center plane 102 extends vertically and longitudinally across the stern and swivel bracket assembly 100. The center plane 102 contains the steering axis 204, as seen in FIG. 4.

Figure 9:
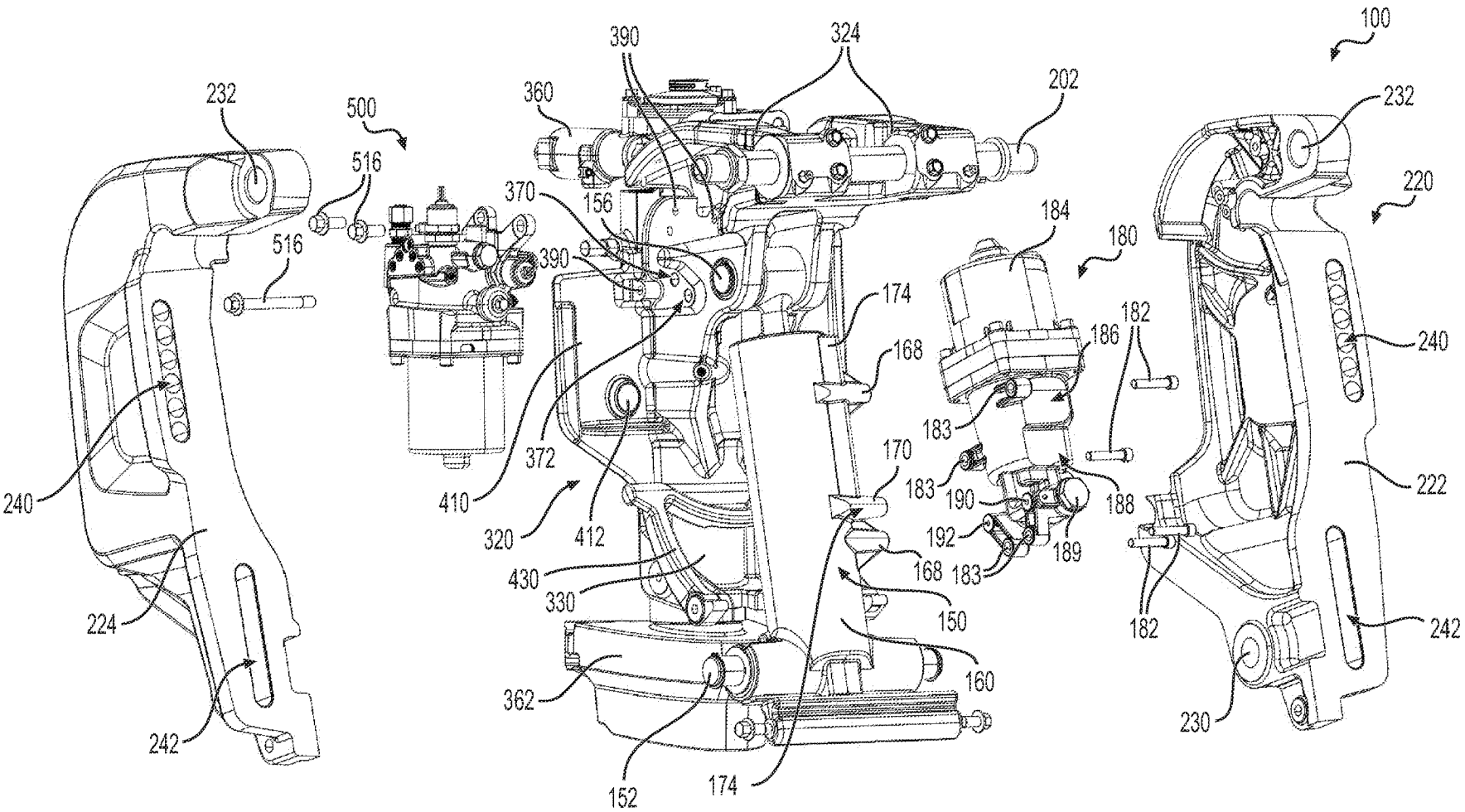
FIG. 9 is an exploded, perspective view taken from a front, top, right side of the stern and swivel bracket assembly of FIG. 5.

The stern bracket 220 includes distinct portions 222, 224. The portions 222, 224 are laterally spaced. The portions 222, 224 contact the stern or other suitable part of the watercraft when the marine outboard engine 40 is mounted to the stern or to the other suitable part of the watercraft. The portion 222 is located on the left side of the center plane 102, and the portion 224 is located on the right side of the center plane 102 when the stern and swivel bracket assembly 100 is mounted to the transom 46 of the watercraft. As best seen in FIGS. 8 and 9, the portions 222, 224 define apertures 230 for receiving a lower pivot axle 152 of the hydraulic linear tilt-trim actuator 150. The portions 222, 224 also define apertures 232 for receiving the tilt axle 202 therethrough. In the present implementation, the tilt axle 202 is fixed with respect to the portions 222, 224 of the stern bracket 220, and the swivel bracket 320 rotates about the tilt axle 202. It is contemplated that in some implementations, the tilt axle 202 could be rotatable in the apertures 232 of the portions 222, 224 of the stern bracket 220, and fixed relative to the swivel bracket 320. An upper pivot axle 156 of the hydraulic linear tilt-trim actuator 150 is received within tabs 326 defined in the swivel bracket 320. The hydraulic linear tilt-trim actuator 150 is thus operatively connected between the stern bracket 220 and the swivel bracket 320.

Still referring to FIGS. 5 to 12, the stern bracket 220 also has a plurality of holes 240 and slots 242 for receiving fasteners (not shown) used to fasten the stern and swivel bracket assembly 100 to the transom 46 of the watercraft. By providing many holes 240 and slots 242, the vertical position of the stern bracket 220, and therefore the stern and swivel bracket assembly 100, relative to the transom 46 can be adjusted.

Referring to FIGS. 5 and 6, the hydraulic linear tilt-trim actuator 150 is located laterally between the portions 222, 224 of the stern bracket 220, forward of the hydraulic steering actuator 200. The hydraulic steering actuator 200 and the hydraulic linear tilt-trim actuator 150 are laterally aligned, as shown in FIGS. 5 and 6. More particularly, the hydraulic linear tilt-trim actuator 150 and the hydraulic steering actuator 200 are located along the lateral center of the stern and swivel bracket assembly 100, e.g. along the center plane 102.

Figure 3:
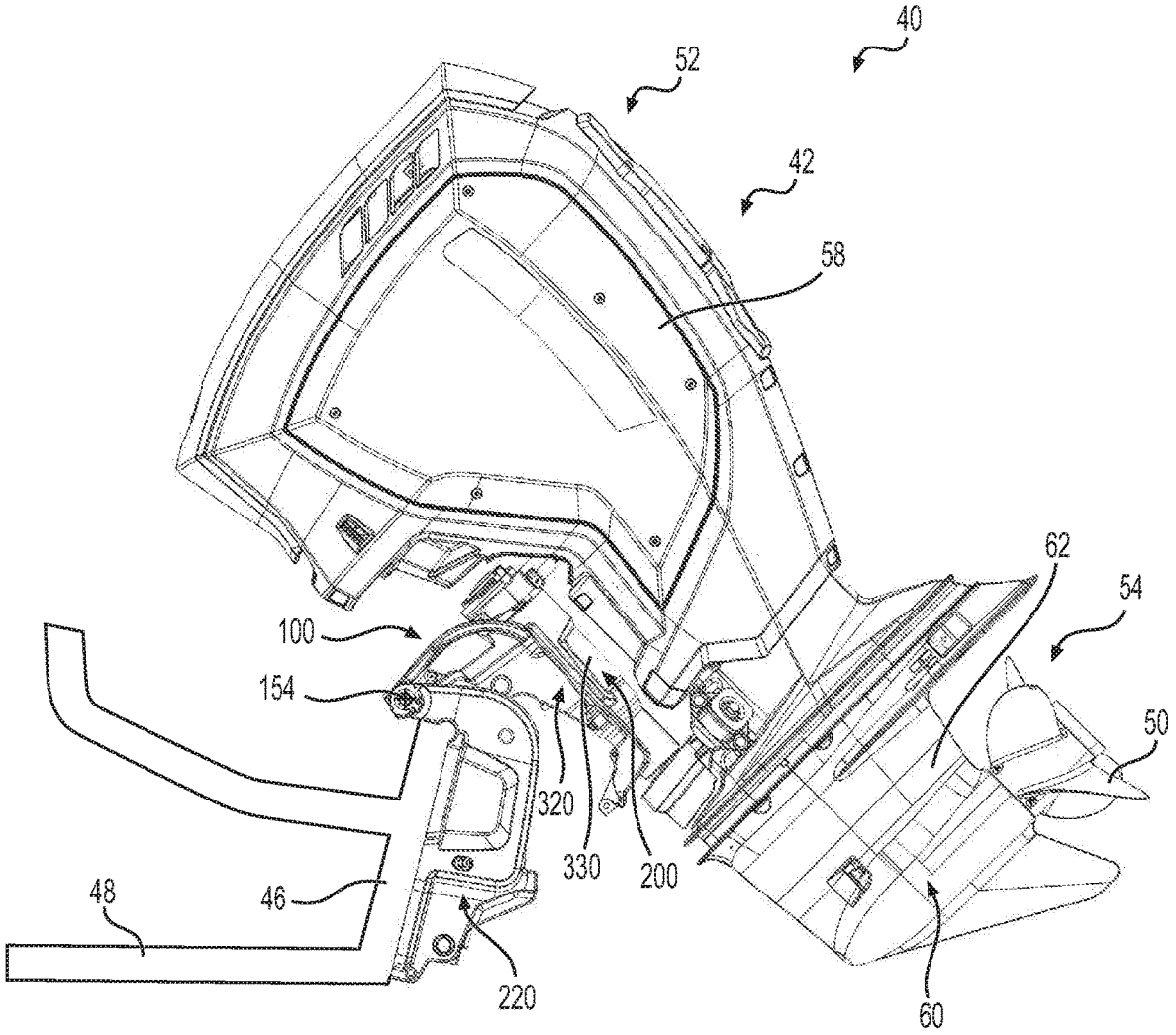
FIG. 3 is a left side elevation view of the marine outboard engine of FIG. 2 in a tilted-up position.

Referring to FIGS. 8, 9, 11 and 12, the hydraulic linear tilt-trim actuator 150 includes a cylinder 160, a piston 162 (FIG. 12) disposed inside a chamber 164 defined in the cylinder 160, and a rod 166 connected to the piston 162 and protruding from the cylinder 160. The rod 166 is pivotally connected to the upper pivot axle 156 of the hydraulic linear tilt-trim actuator 150. As can be seen in FIG. 8, the cylinder 160 further has four mounts 168 projecting from the cylinder 160 toward the left side. As can also be seen in FIG. 8, the cylinder 160 also has trim-up and trim-down hydraulic ports 170, 172 projecting from the cylinder 160 toward the left side. The trim-up and trim-down hydraulic ports 170, 172 face outward in a left lateral direction. Passages 174 formed within the cylinder 160 extend between the trim-up and trim-down hydraulic ports 170, 172 respectively and the chamber 164 below and above the piston 162 respectively. The trim-up and trim-down hydraulic ports 170, 172 and the passages 174 permit flow of hydraulic fluid to and from the hydraulic linear tilt-trim actuator 150. As such, the trim-up and trim-down hydraulic ports 170, 172 are fluidly connected to the chamber 164. Supplying hydraulic fluid under the piston 162 causes the hydraulic linear tilt-trim actuator 150 to extend in a tilted/trimmed-up position, as seen in FIG. 3. Supplying hydraulic fluid above the piston 162 causes the hydraulic linear tilt-trim actuator 150 to retract in a tilted/trimmed-down position, as seen in FIG. 2.

Still referring to FIGS. 8, 9, 11 and 12, a hydraulic tilt-trim pump assembly 180 supplies the hydraulic fluid to the hydraulic linear tilt-trim actuator 150. The hydraulic tilt-trim pump assembly 180 is mounted to the four mounts 168 of the hydraulic linear tilt-trim actuator 150 via four fasteners 182. The four fasteners 182 extend through four apertures 183 defined in the hydraulic tilt-trim pump assembly 180, as best seen in FIGS. 8 and 9. It is contemplated that there could be more or less than four mounts 168 and apertures 183, in which case there would be a corresponding number of fasteners 182. In the present implementation, the mounts 168 are threaded apertures. Other types of mounts 168 are contemplated, in which case the fasteners 182 may need to be replaced by components suitable for fastening to the different type of mounts 168. It is also contemplated that one or more of the mounts 168 could differ from the other mounts 168.

The hydraulic tilt-trim pump assembly 180 is located on a left side of the center plane 102. More particularly, the hydraulic tilt-trim pump assembly 180 is located in a space extending laterally between the portion 222 of the stern bracket 220 and the hydraulic linear tilt-trim actuator 150. Moreover, the hydraulic tilt-trim pump assembly 180 is located below the tilt/trim axis 154. As such, the hydraulic tilt-trim pump assembly 180 moves with the hydraulic linear tilt-trim actuator 150 when the the hydraulic linear tilt-trim actuator 150 extends to tilt or trim the swivel bracket 320 upward about the tilt/trim axis 154, or retracts to tilt or trim the swivel bracket 320 downward about the tilt/trim axis 154.

The hydraulic tilt-trim pump assembly 180 includes a motor 184, a pump 186 operatively connected to the motor 184, and a manifold 188 fluidly connected to the pump 186. The pump 186 is a bi-directional electric pump. The direction of the flow of hydraulic fluid from the pump 186 can be changed by changing the direction of rotation of the motor 184. It is contemplated that the pump 186 could be a unidirectional pump, in which case it is contemplated that a system of valves integrated into the manifold 188 could be used to vary the direction of the flow. It is also contemplated that other types of pumps could be used, such as, for example, axial flow pumps or reciprocating pumps. The volumes of the pump 186 and manifold 188 act as a hydraulic fluid reservoir. Hydraulic fluid can be added to the pump 186 and manifold 188 via an inlet 189.

Still referring to FIGS. 8, 9, 11 and 12, the hydraulic tilt-trim pump assembly 180 defines trim-up and trim-down hydraulic ports 190, 192 (FIG. 9). The trim-up and trim-down hydraulic ports 190, 192 are fluidly connected to the manifold 188. The trim-up and trim-down hydraulic ports 190, 192 face laterally outward of the hydraulic tilt-trim pump assembly 180 in a right lateral direction. In other words, the trim-up and trim-down hydraulic ports 190, 192 face laterally outward toward the right side of the stern and swivel bracket assembly 100.

When the hydraulic tilt-trim pump assembly 180 is mounted to the mounts 168, the trim-up and trim-down hydraulic ports 190, 192 of the hydraulic tilt-trim pump assembly 180 abut the corresponding trim-up and trim-down hydraulic ports 170, 172 of the hydraulic linear tilt-trim actuator 150. As such, the trim-up and trim-down hydraulic ports 190, 192 of the hydraulic tilt-trim pump assembly 180 are fluidly connected to the trim-up and trim-down hydraulic ports 170, 172 of the hydraulic linear tilt-trim actuator 150. In some implementations, gaskets could be disposed between the trim-up hydraulic ports 170, 190 and the trim-down hydraulic ports 172, 192, respectively. In yet other implementations, the trim-up hydraulic ports 170, 190 could be fluidly connected to each other via hoses or nipples.

Similarly, in some implementations, the trim-down hydraulic ports 172, 192, could be fluidly connected to each other via hoses or nipples.

Figure 11:
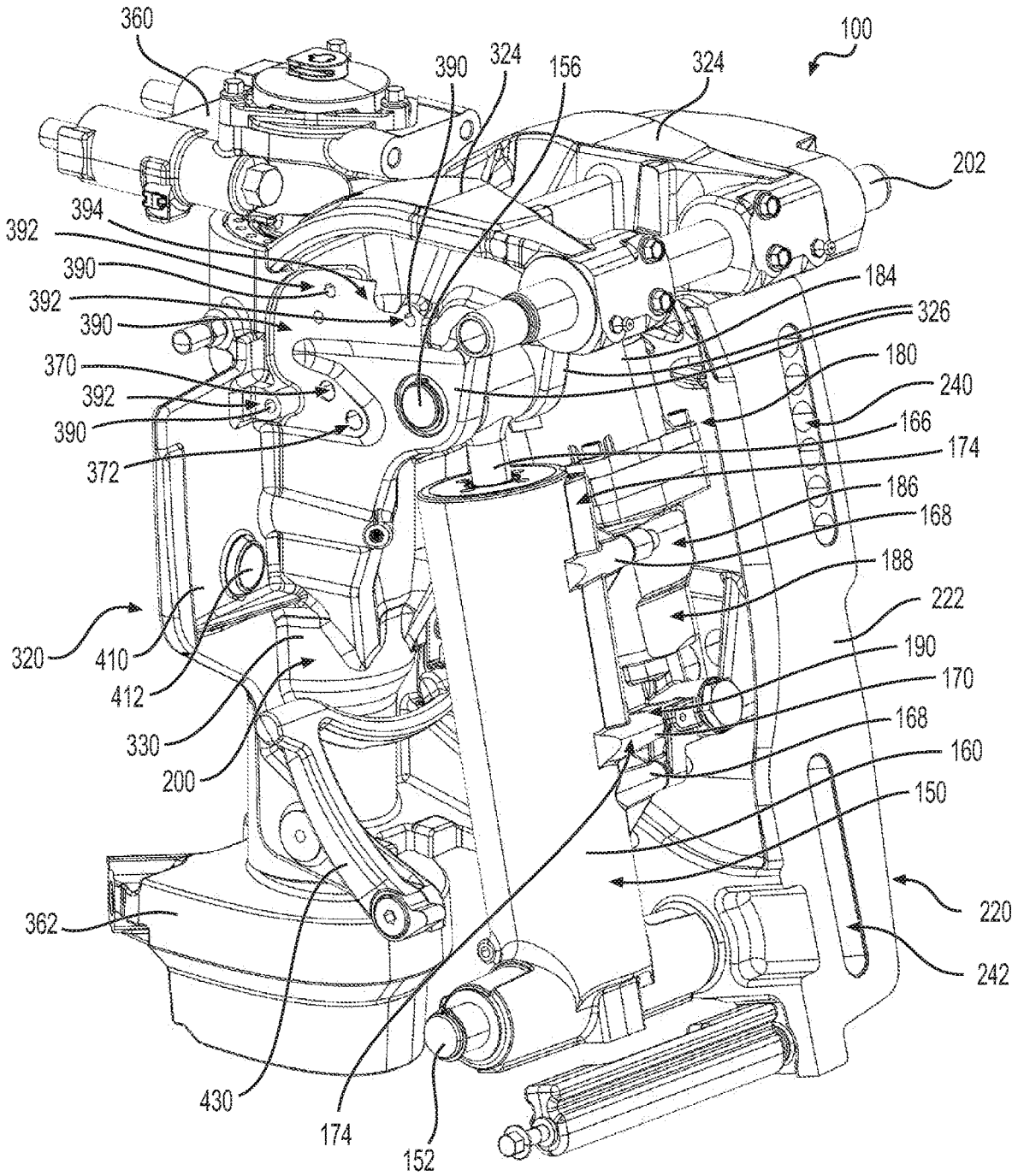
FIG. 11 is a perspective view taken from a front, top, right side of the stern and swivel bracket assembly of FIG. 5, with a right portion of the stern bracket and the hydraulic steering component removed.
Figure 12:
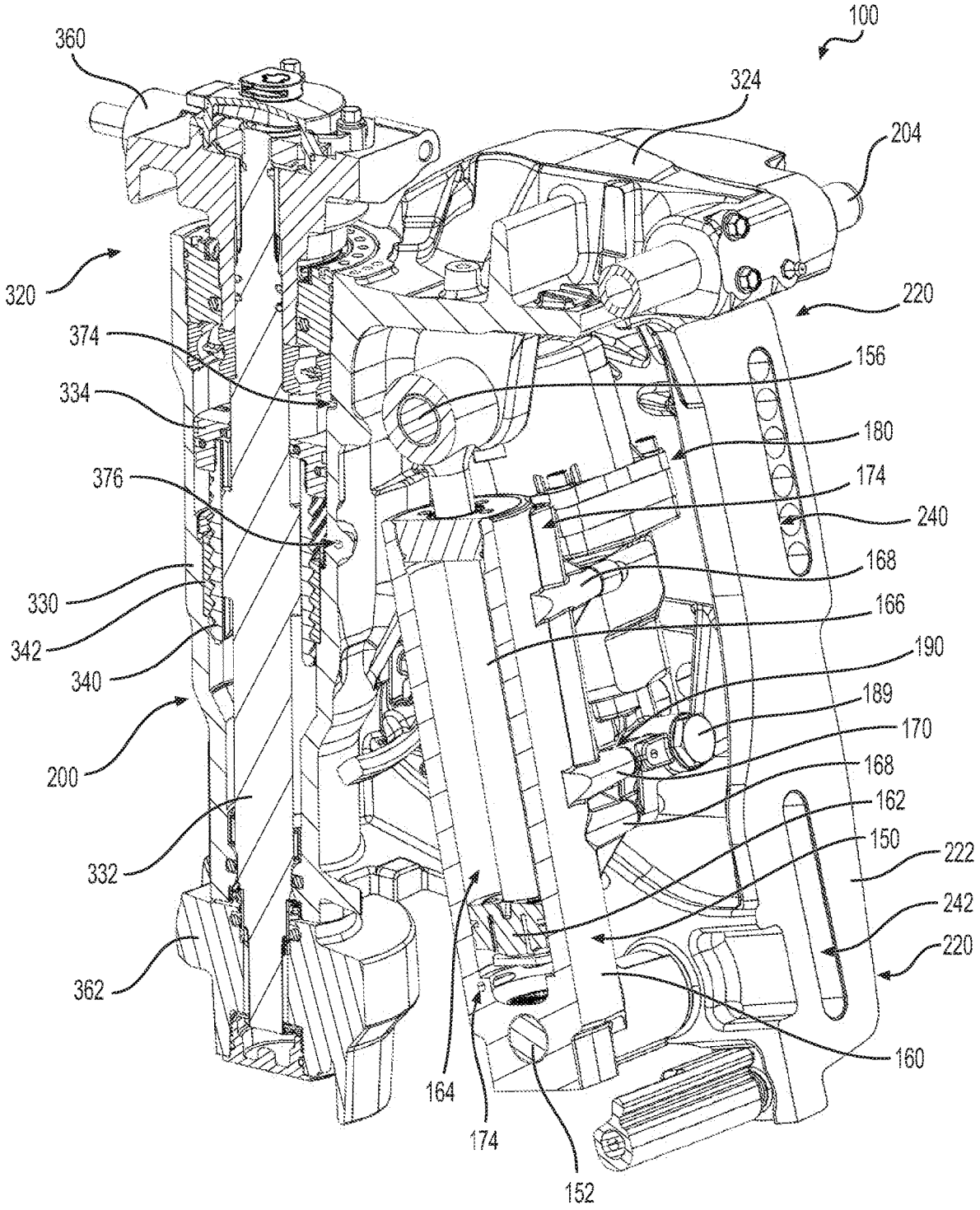
FIG. 12 is a perspective view taken from a front, top, right side of a longitudinal cross-section of the stern and swivel bracket assembly of FIG. 11.

Referring to FIGS. 9, 11 and 12, to pivot the swivel bracket 320 away from the stern bracket 220 about the tilt/trim axis 154 (e.g. trim up), hydraulic fluid is pumped by the pump 186 in the chamber 164 of the cylinder 160 below the piston 162 via the trim-up hydraulic ports 170, 190, causing the piston 162 to move upwardly inside the chamber 164 of the cylinder 160. Simultaneously, hydraulic fluid is pumped out of the chamber 164 of the cylinder 160 from above the piston 162 via the trim-down hydraulic ports 172, 192 by the pump 186. To pivot the swivel bracket 320 about the tilt-trim axis 154 back toward the stern bracket 220 (e.g. trim down) from the position shown in FIG. 3, hydraulic fluid can be pumped out of the chamber 164 of the cylinder 160 by the pump 186 from below the piston 162 via the trim-up hydraulic ports 170, 190, and simultaneously pumped by the pump 186 in the chamber 164 of the cylinder 160 above the piston via the trim-down hydraulic ports 172, 192 causing the piston 162 to move downwardly inside the chamber 164, or hydraulic fluid can be pushed out of the chamber 164 of the cylinder 160 by the piston 162 via the trim-up hydraulic ports 170, 190 due to the weight of the swivel bracket 320 and the drive unit 42 pushing toward the stern bracket 220.

The hydraulic tilt-trim pump assembly 180 is actuated in response to the actuation by the driver of the watercraft of tilt and trim controls (not shown) in the form of switches, buttons or levers for example. It is contemplated that the hydraulic tilt-trim pump assembly 180 could also be controlled by a control unit (not shown) of the marine outboard engine 40 or of the watercraft to automatically adjust a trim of the drive unit 42 based on various parameters such as watercraft speed, engine speed and engine torque for example.

Referring back to FIGS. 5 to 12, the swivel bracket 320 will be described in more detail. The swivel bracket 320 includes the hydraulic steering actuator 200 which is a hydraulic rotary actuator. As can be seen in FIG. 12, the hydraulic steering actuator 200 includes a cylindrical main body 330, a central shaft 332 disposed inside the main body 330 and protruding from the ends thereof, and a piston 334 surrounding the central shaft 332 and disposed inside the main body 330. The main body 330 is centrally located along the swivel bracket 320 and is integrally formed therewith. It is contemplated that in other implementations the main body 330 could be fastened, welded, or otherwise connected to the swivel bracket 320. The central shaft 332 is coaxial with the steering axis 204.

An upper generally U-shaped drive unit mounting bracket 360 is connected to an upper end of the central shaft 332 to rotate therewith. Similarly, a lower generally U-shaped drive unit mounting bracket 362 is connected to a lower end of the central shaft 332 to rotate therewith. The hydraulic steering actuator 200 thus extends between the upper and lower drive unit mounting brackets 360, 362. The upper and lower drive unit mounting brackets 360, 362 are connected to the drive unit 42 so as to support the drive unit 42 onto the stern and swivel bracket assembly 100. As a result, the drive unit 42, the drive unit mounting brackets 360, 362 and the central shaft 332 are all rotationally fixed relative to each other.

The piston 334 is engaged to the central shaft 332 via oblique spline teeth on the central shaft 332 and matching splines on the inside diameter of the piston 334. The piston 334 is slidably engaged to the inside wall of the main body 330 via longitudinal splined teeth 340 on the outer diameter of the piston 334 and matching splines 342 on the inside diameter of the main body 330. By applying pressure on the piston 334, by supplying hydraulic fluid inside the main body 330 on one side of the piston 334, the piston 334 slides along the central shaft 332. Since the main body 330 is rotationally fixed relative to the swivel bracket 320 and the piston 334 is rotational fixed relative to the main body 330, the oblique spline teeth 340 cause the central shaft 332 and therefore the upper and lower drive unit mounting brackets 360, 362 to pivot about the steering axis 204. The connections between the drive unit 42 and the upper and lower drive unit mounting brackets 360, 362 cause the drive unit 42 to pivot about the steering axis 204 together with the central shaft 332.

Supplying hydraulic fluid to one side of the piston 334 causes the drive unit 42 to steer left. Supplying hydraulic fluid to the other side of the piston 334 causes the drive unit 42 to steer right. In the present implementation, supplying hydraulic fluid above the piston 334 causes the drive unit 42 to steer left, for example to a position as seen in FIG. 4, and supplying hydraulic fluid below the piston 334 causes the drive unit 42 to steer right. U.S. Pat. No. 7,736,206 B1, issued Jun. 15, 2010, the entirety of which is incorporated herein by reference, provides additional details regarding rotary actuators similar in construction to the hydraulic steering actuator 200.

Referring to FIGS. 9 to 12, the swivel bracket 320 defines hydraulic steer ports 370, 372 facing laterally outward of the main body 330 in a right lateral direction. In other words, the hydraulic steer ports 370, 372 face laterally outward toward the right side of the stern and swivel bracket assembly 100. A passage 374 defined within the main body 330 extends between the hydraulic steer port 370 and the inside of the main body 330 above the piston 334. The hydraulic steer port 370 thus corresponds to a hydraulic steer-left port. Similarly, a passage 376 defined within the main body 330 extends between the hydraulic steer port 372 and the inside of the main body 330 below the piston 334. The hydraulic steer port 372 thus corresponds to a hydraulic steer-right port. The hydraulic steer ports 370, 372 and the passages 374, 376 permit the flow of hydraulic fluid therein. As such, the hydraulic steer ports 370, 372 are fluidly connected to the inside of the main body 330 of the hydraulic steering actuator 200.

Still referring to FIGS. 9 to 12, the swivel bracket 320 has three swivel bracket mounts 390 located on the right side of the main body 330 and facing laterally outward toward the right side of the stern and swivel bracket assembly 100. As such, the three swivel bracket mounts 390 are located laterally between the hydraulic steering actuator 200 and the portion 224 of the stern bracket 220. Referring to FIG. 11, each of the three swivel bracket mounts 390 is defined by a threaded hole 392 defined within the main body 330, but could be defined otherwise in other implementations. The three swivel bracket mounts 390 define a bolt pattern 394 which includes the three threaded holes 392 disposed in a triangular arrangement.

Figure 10:
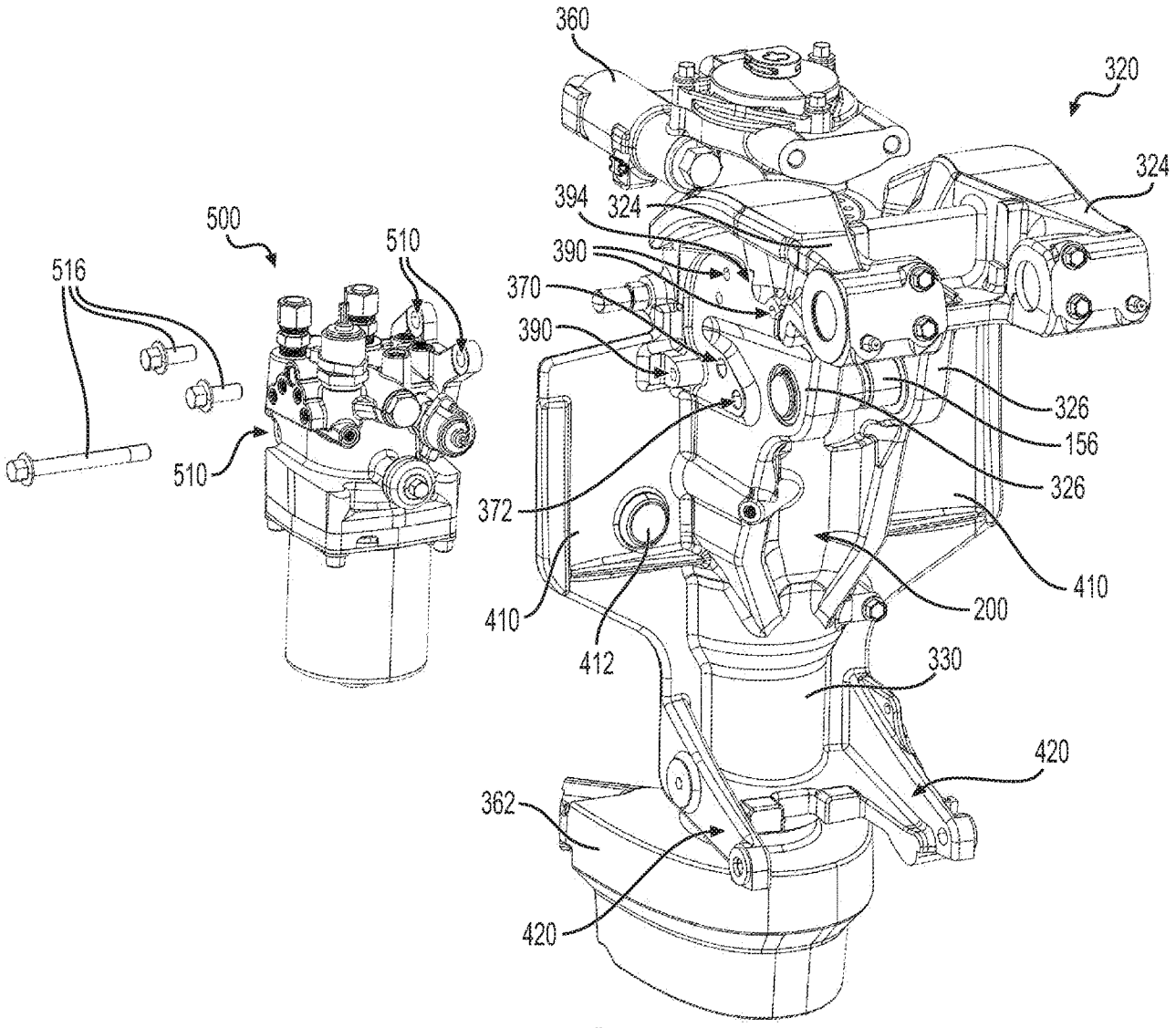
FIG. 10 is an exploded, perspective view taken from a front, top, right side of the swivel bracket of FIG. 5, and a hydraulic steering component.

Still referring to FIGS. 5 to 12, two wings 410 project laterally from the main body 330. The wings 410 are behind the stern bracket 220. A removable plug 412 is provided in the wing 410 located on the right side of the swivel bracket 320. When the plug 412 is removed, access from the rear of the stern and swivel bracket assembly 100 to the space located forward of the wing 410 located on the right side of the swivel bracket 320 is available. Referring to FIG. 10, the swivel bracket 320 further has forwardly extending arms 420 provided in a lower portion of the main body 330. A tilt lock bracket 430 (FIG. 11) is pivotally connected to the arms 420 of the swivel bracket 320. When the swivel bracket 320 is tilted-up, the tilt lock bracket 430 can be manually pivoted from a folded position to an extended position to abut the stern bracket 220 to prevent the swivel bracket 320 from pivoting back down about the tilt/trim axis 154 towards the tilted-down position.

Referring to FIGS. 5 to 12, to supply hydraulic fluid to the hydraulic steering actuator 200 via the hydraulic steer ports 370, 372 and the passages 374, 376, the stern and swivel bracket assembly 100 further includes a hydraulic steering component that is part of a hydraulic steering system of the watercraft. The hydraulic steering component that is illustrated in FIGS. 1 to 10 and 13 to 14 is a power steering unit 500 of a helm-actuated power steering system.

Figure 13:
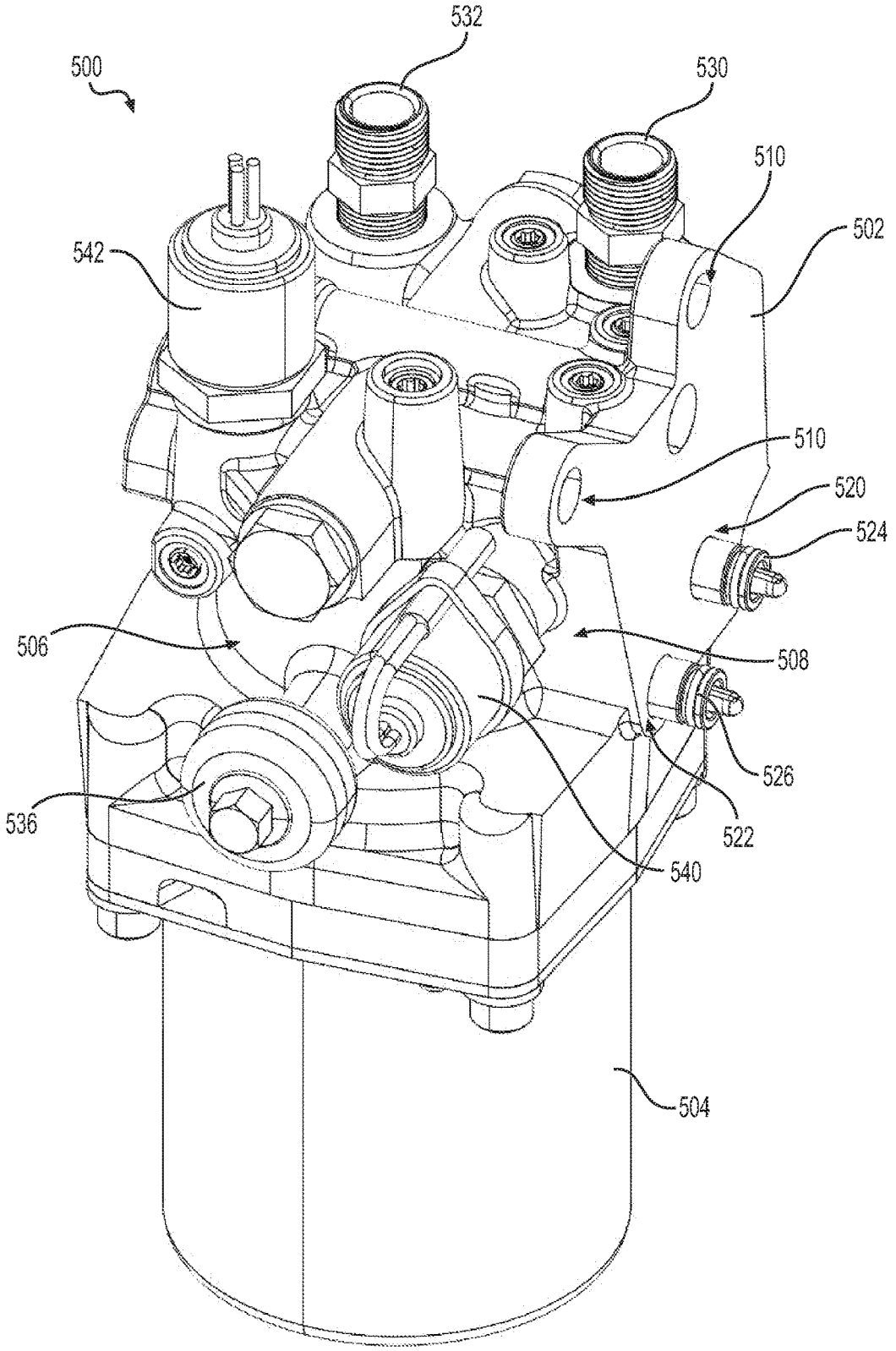
FIG. 13 is a perspective view taken from a front, top, left side of the hydraulic steering component of the stern and swivel bracket assembly of FIG. 5, the hydraulic steering component being a power steering unit of a helm-actuated power steering system.
Figure 14:
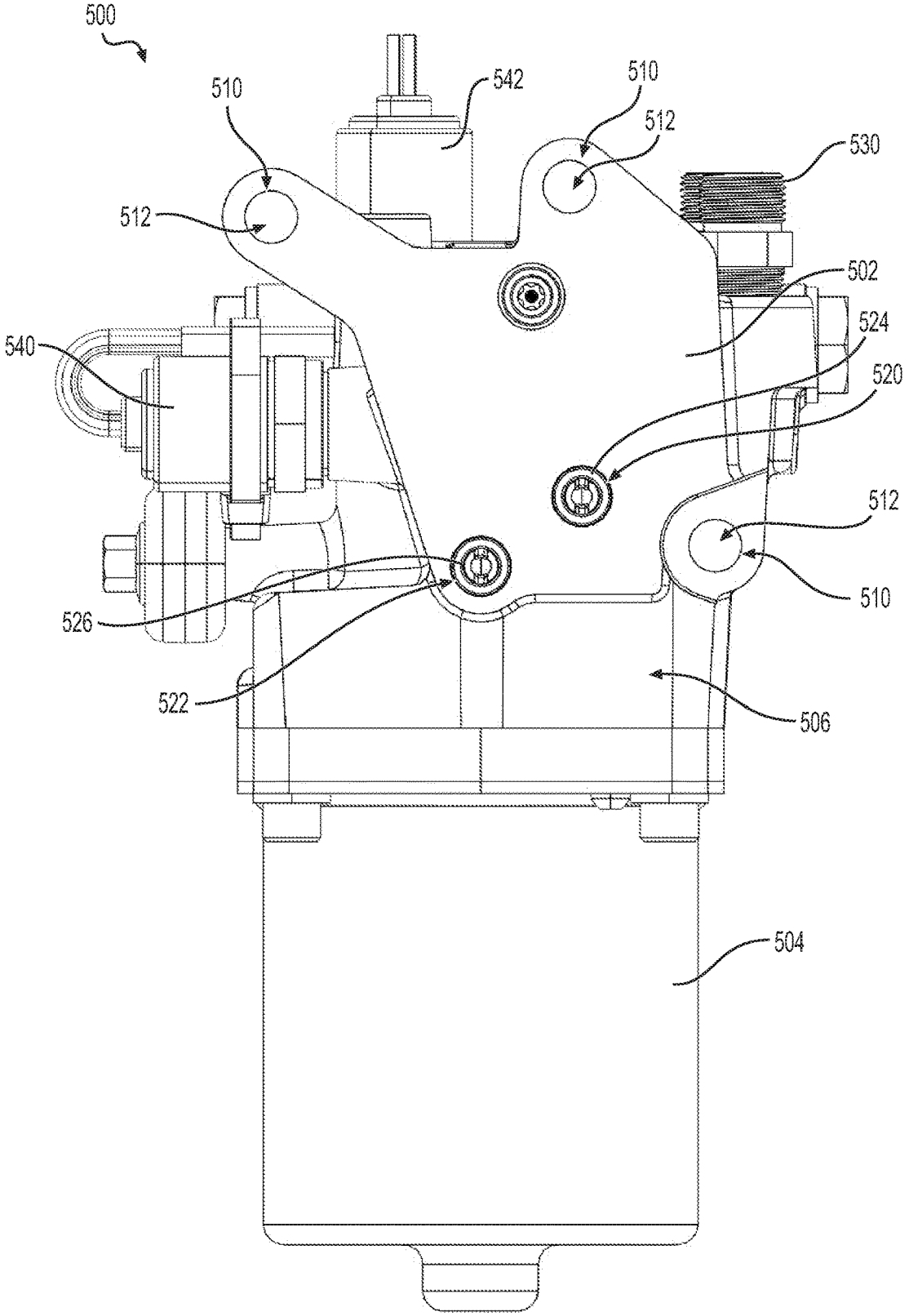
FIG. 14 is a left side elevation view of the power steering unit of FIG. 13.

Referring now to FIGS. 10, 13 and 14, the power steering unit 500 includes a body 502, a motor 504 connected to the body 502, a pump 506 operatively connected to the motor 504, and a manifold 508 fluidly connected to the pump 506. The pump 506 is a bi-directional electric pump. The direction of the flow of hydraulic fluid from the pump 506 can be changed by changing the direction of rotation of the motor 504. It is contemplated that the pump 506 could be a unidirectional pump, in which case it is contemplated that a system of valves integrated into the manifold 508 could be used to vary the direction of the flow. It is also contemplated that other types of pumps could be used, such as, for example, axial flow pumps or reciprocating pumps. U.S. Pat. No. 9,499,247 B1, issued Nov. 22, 2016, the entirety of which is incorporated herein by reference, provides details regarding the construction and operation of a power steering unit similar to the power steering unit 500.

The body 502 of the power steering unit 500 also defines three component mounts 510. Each component mount 510 corresponds to a hole 512 defined in the body 502. The three holes 512 are spaced apart from each other so as to correspond to the bolt pattern 394 of the three swivel bracket mounts 390. As seen in FIGS. 8 to 10, three fasteners 516 extend through the three holes 512 of the body 502 of the power steering unit 500 and threadedly engage the three threaded holes 392 of the swivel bracket mounts 390 so as to mount the power steering unit 500 thereto. It is contemplated that there could be more or less than three swivel bracket mounts 390 and component mounts 510, in which case there would be a corresponding number of fasteners 516. In the present implementation, the swivel bracket mounts 390 are defined by the threaded holes 392. Other types of swivel bracket mounts 390 are contemplated, in which case the fasteners 516 may need to be replaced by components suitable for fastening to the different type of swivel bracket mounts 390. It is also contemplated that one or more of the swivel bracket mounts 390 could differ from the other swivel bracket mounts 390. It is further contemplated that fasteners could be incorporated into one or both of the component mounts 510 and the swivel bracket mounts 390.

As a result, when the power steering unit 500 is mounted to the swivel bracket 320 via the swivel bracket mounts 390, the power steering unit 500 is located on the right side of the center plane 102, as seen in FIG. 5. More particularly, the power steering unit 500 is located in the space extending laterally between the portion 224 of the stern bracket 220 and the hydraulic linear tilt-trim actuator 150. The power steering unit 500 is also located below the tilt/trim axis 154. Moreover, since the power steering unit 500 is mounted to the swivel bracket 320, the power steering unit 500 pivots together with the swivel bracket 320 about the tilt/trim axis 154.

Still referring to FIGS. 10, 13 and 14, the power steering unit 500 defines hydraulic steer ports 520, 522. The hydraulic steer ports 520, 522 are fluidly connected to the manifold 508. The hydraulic steer ports 520, 522 face laterally outward of the power steering unit 500 in a left lateral direction. In other words, the hydraulic steer ports 520, 522 face laterally outward toward the left side of the stern and swivel bracket assembly 100. Hydraulic nipples 524, 526 are received within the hydraulic steer ports 520, 522 and project laterally outwardly from the body 502.

Steer-left and steer-right fittings 530, 532 are provided on the body 502. The fittings 530, 532 are fluidly connected to the manifold 508. The fittings 530, 532 respectively receive port and starboard hydraulic helm hoses (not shown) that are fluidly connected to a helm assembly (not shown) of the watercraft. The helm assembly may also include a hydraulic fluid reservoir. The hydraulic steer port 520 is fluidly connected to the fitting 530, and thus corresponds to a hydraulic steer-left fitting. The hydraulic steer port 522 is fluidly connected to the fitting 532, and thus corresponds to a hydraulic steer-right fitting.

Referring to FIGS. 8 to 12, when the power steering unit 500 is mounted to the swivel bracket 320, the hydraulic steer port 520 is fluidly connected to the hydraulic steer port 370 of the swivel bracket 320 through the hydraulic nipple 524. Similarly, the hydraulic steer port 522 is fluidly connected to the hydraulic steer port 372 of the swivel bracket 320 through the hydraulic nipple 526. As such, the hydraulic steer-left and steer-right ports 520, 522 of the power steering unit 500 are fluidly connected to the the hydraulic steer-left and steer-right ports 370, 372 of the swivel bracket 320.

Referring to FIGS. 10 to 14, in order to assist the operator steering the drive unit 42, and more precisely to pivot the upper and lower drive unit mounting brackets 360, 362 so as to cause the drive unit 42 to pivot left about the steering axis 204 together with the central shaft 332 so as to steer the watercraft to the left (as shown in FIG. 4), hydraulic fluid is pumped by the pump 506 in the main body 330 via the hydraulic steer-left ports 370, 520 and, simultaneously, hydraulic fluid is pumped out of the main body 330 via the hydraulic steer-right ports 372, 522, causing the piston 334 to move downwardly inside the main body 330. Conversely, to aid in steering the drive unit 42 to the right, hydraulic fluid is pumped by the pump 506 in the main body 330 via the hydraulic steer-right ports 372, 522 and, simultaneously, hydraulic fluid is pumped out of the main body 330 via the hydraulic steer-left ports 370, 520, causing the piston 334 to move upwardly inside the main body 330. Depending on the type of the pump 506 and the configuration of the power steering unit 500, the direction of flow of hydraulic fluid within the hydraulic steer-left and steer-right ports 520, 522 of the power steering unit 500 can be controlled by changing the direction of rotation of the motor 504, and/or by changing the configuration of a system of valves integrated into the manifold 508. Such changing of the direction of flow of hydraulic fluid permits the power steering unit 500 to facilitate both left and right steering motion of the drive unit 42.

Referring to FIGS. 13 and 14, an anode 536 is connected to the front of the body 502. The anode 536 helps prevent corrosion of the components of the power steering unit 500. It is contemplated that the anode 536 could be omitted. The power steering unit 500 further includes port and starboard pressure sensors 540, 542. The pressure sensors 540, 542 are positioned to sense the hydraulic pressure in the manifold 508 between the hydraulic steer ports 520, 522 and the fittings 530, 532 respectively.

Generally described, upon actuation of the helm assembly of the watercraft, hydraulic fluid is displaced by a helm pump (not shown) and one of the pressure sensors 540, 542 senses the hydraulic pressure of hydraulic fluid flowing into a valve unit (not shown) of the manifold 508, while the other of the pressure sensors 540, 542 senses the hydraulic pressure of hydraulic fluid flowing out of the valve unit. The pressure sensors 540, 542 send a signal representative of the sensed pressure to a controller (not shown). The direction and speed at which the motor 504 is operated, which thereby regulates the operation of the pump 506, is determined at least in part by the hydraulic fluid pressure sensed by the pressure sensors 540, 542. If the difference between the pressures of the hydraulic fluid sensed by the pressure sensors 540, 542 are above a predetermined value (e.g. 6 PSI for example) the controller causes the motor 504 to run. As a result, the power steering unit 500 facilitates both left and right steering motion of the drive unit 42 upon actuation of the helm assembly.

As will be described below with reference to FIGS. 15 to 21, other hydraulic steering components corresponding to different types of hydraulic steering systems can be mounted to the swivel bracket mounts 390 instead of the power steering unit 500. These other hydraulic steering components have component mounts similar to the component mounts 510 described above with respect to the power steering unit 500. In other words, in the hydraulic steering components shown in FIGS. 15 to 21, the component mounts are spaced apart in an arrangement that corresponds the bolt pattern 394 of the swivel bracket mounts 390. Therefore, switching between different hydraulic steering components that are to be mounted to the swivel bracket instead of the power steering unit 500 is facilitated since no modification to the stern and swivel bracket assembly 100 is required.

Figure 15:
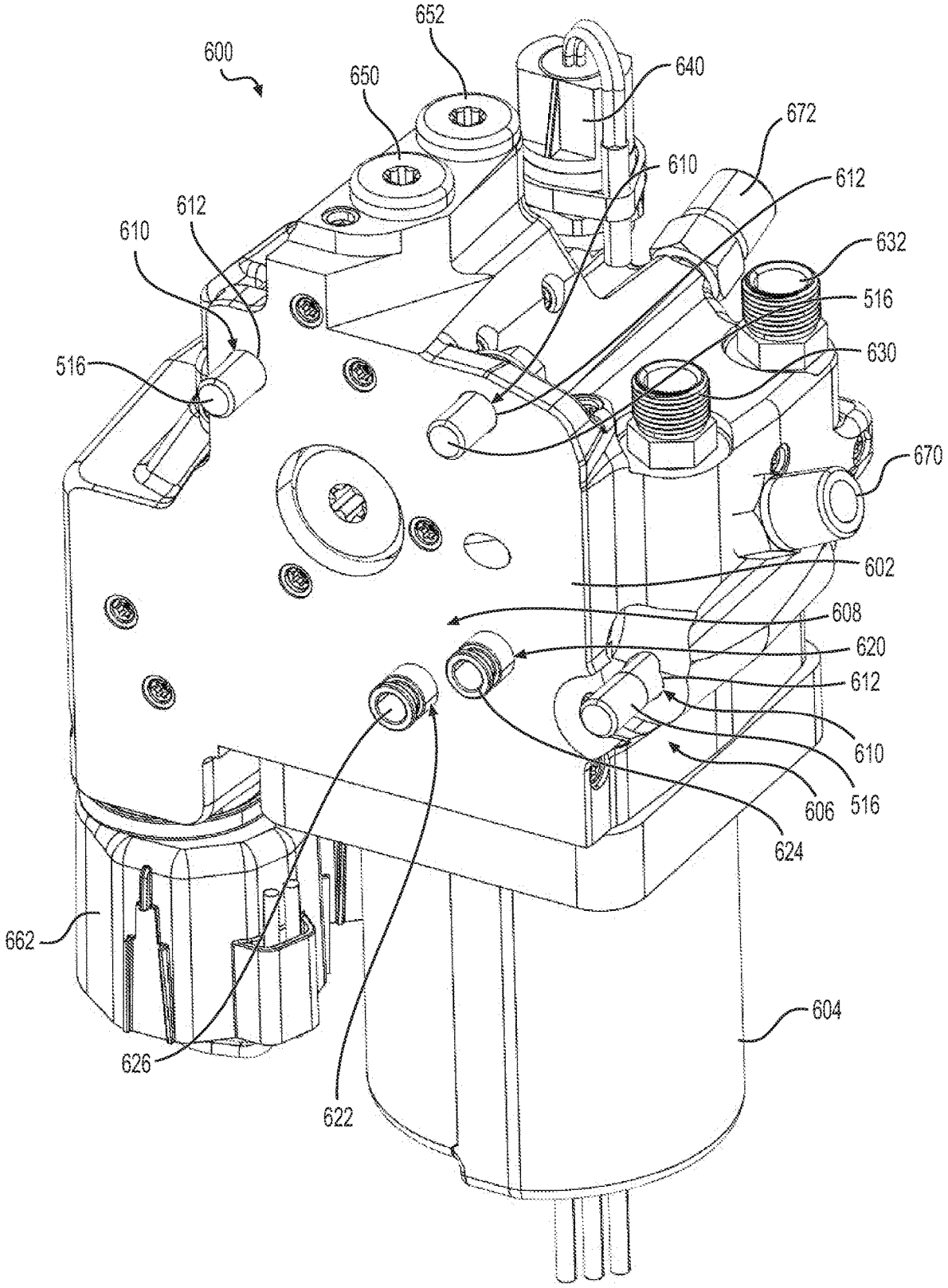
FIG. 15 is a perspective view taken from a rear, top, left side of an alternative hydraulic steering component of the stern and swivel bracket assembly of FIG. 5, this hydraulic steering component being a power steering unit of a joy-stick-actuated power steering system.
Figure 16:
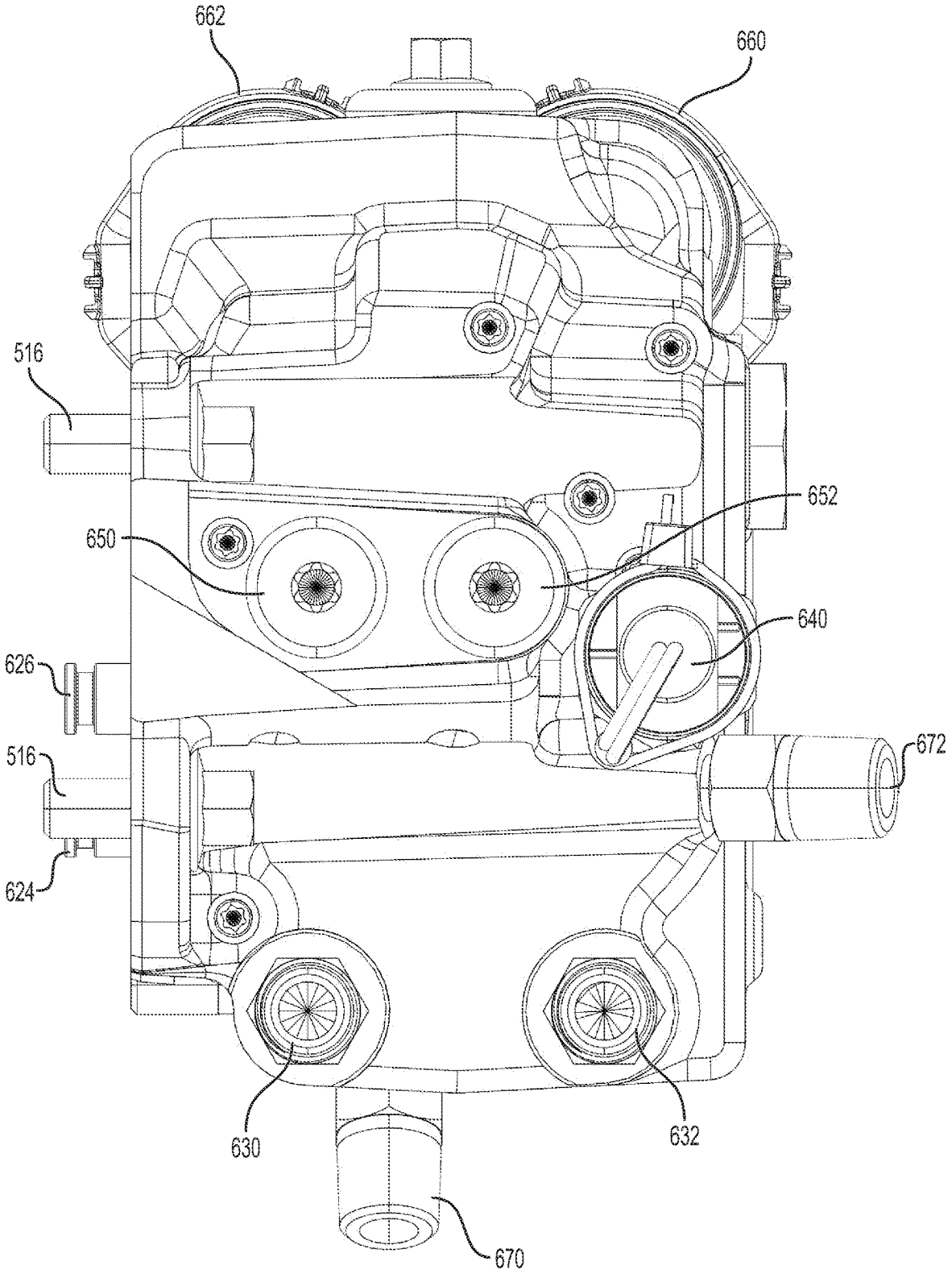
FIG. 16 is a top plan view of the power steering unit of FIG. 15.
Figure 17:
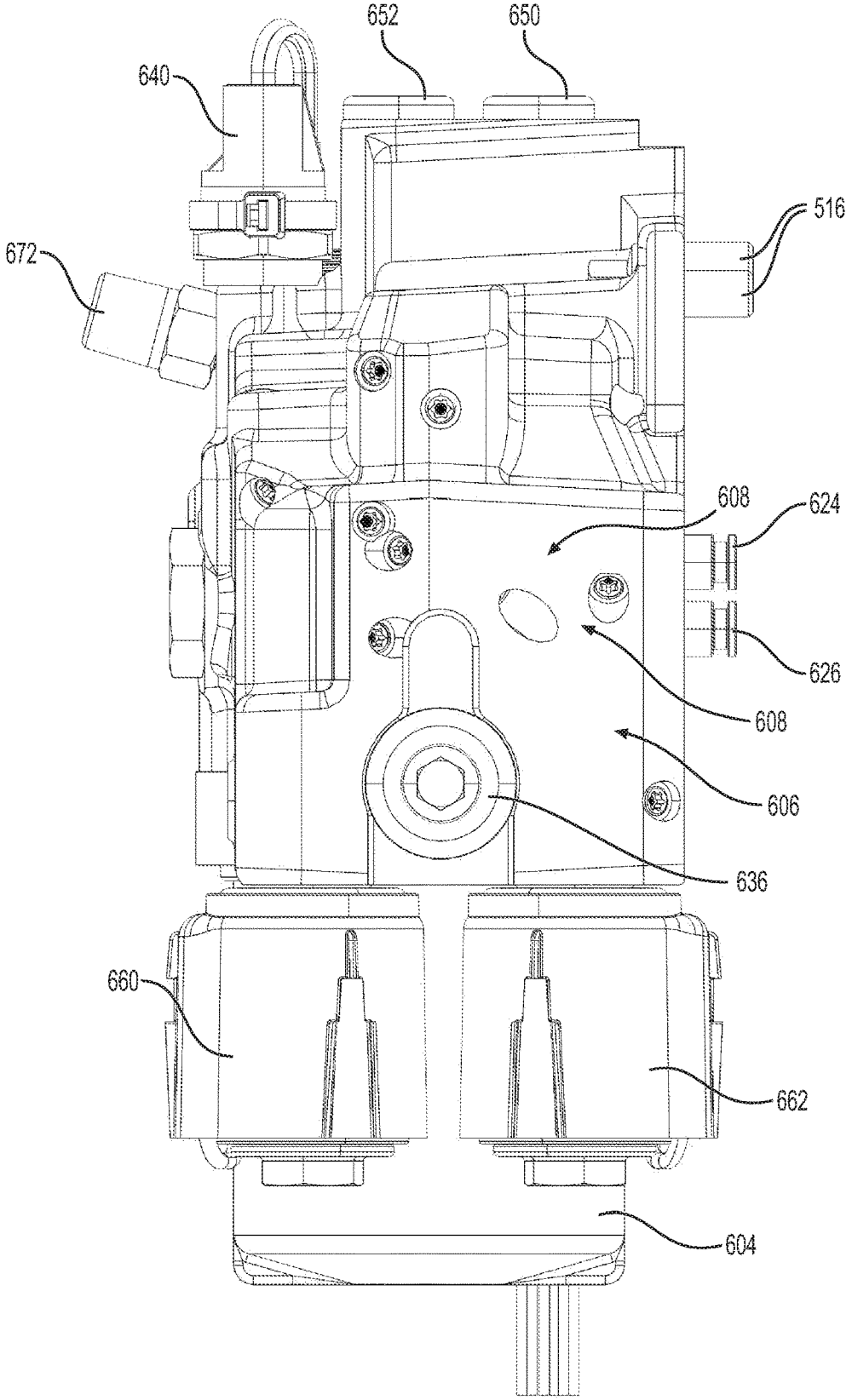
FIG. 17 is a front elevation view of the power steering unit of FIG. 16.

Turning now to FIGS. 15 to 17, a hydraulic steering component that can be used with the stern and swivel bracket assembly 100 instead of the power steering unit 500 described above without having to modify the stern and swivel bracket assembly 100, will be described. The hydraulic steering component illustrated in FIGS. 15 to 17 is a power steering unit 600 of a joystick-actuated power steering system. The hydraulic steering component 600 includes elements that are the same as or similar to those described with reference to the power steering unit 500. Therefore, for simplicity, elements of the power steering unit 600 that are the same as or similar to those of the power steering unit 500 have been labeled with the same reference numerals, but in the with the first digit of the numeral (i.e. 5) changed to a 6, and will not be described again in detail.

The power steering unit 600 has three component mounts 610. Each of the component mounts 610 corresponds to a hole 612 defined in the body 602. The three holes 612 are spaced apart from each other so as to correspond to the bolt pattern 394 of the swivel bracket mounts 390. As such, the power steering unit 600 is mountable to the swivel bracket 320 via three fasteners 516 just like the power steering unit 500. The three fasteners 516 mounting the power steering unit 600 to the swivel bracket 320 can have lengths that differ from each other and/or from the lengths illustrated in FIGS. 8 to 10. In addition, the power steering unit 600 has hydraulic steer-left and steer-right ports 620, 622 and hydraulic nipples 624, 626 arranged in a similar fashion as in the power steering unit 500.

The power steering unit 600 is designed to be used on a watercraft having two or more marine outboard engines 40 mounted to the stern thereof, and each marine outboard engine 40 has a respective power steering unit 600 mounted to its respective swivel bracket 320 of its stern and swivel bracket assembly 100. It is contemplated that the power steering unit 600 could also be used on a watercraft having only one marine outboard engine 40. The power steering unit 600 is also designed to be operated in combination with an electronic helm assembly (not shown) of the watercraft, which includes a hydraulic helm and an electronic joystick with position sensors, that sends data to a control unit (not shown) that can control the two or more power steering units 600 on different marine outboard engines 40 of the watercraft in response to steering inputs from the hydraulic helm and the joystick. The power steering unit 600 further has a pressure sensor 640 that is fluidly connected to a valve unit (not shown) provided in the manifold 608.

The power steering unit 600 has port and starboard position-setting screws 650, 652. The screws 650, 652 can be set depending on whether the power steering unit 600 is mounted to the swivel bracket 320 corresponding to the marine outboard engine 40 mounted on a port or starboard side of the stern of the watercraft. The power steering unit 600 further includes solenoids 660, 662 that control a valve unit provided in the manifold 608. The control unit is operatively connected to the solenoids 660, 662, the pressure sensor 640 and the pump 606. Therefore, in response to steering inputs from the hydraulic helm or the electronic joystick, the flow of hydraulic fluid within the hydraulic steer-left and steer-right ports 620, 622 and hydraulic nipples 624, 626 is controlled and permit the steering motion of the drive unit 42. Functional check ports 670, 672 are also fluidly connected to the manifold 608 and are used at factory for quality control purposes. U.S. patent application Ser. No. 15/799,468, titled "Hydraulic Steering System For A Watercraft", the entirety of which is incorporated herein by reference, provides details regarding the construction and operation of a power steering unit similar to the power steering unit 600.

Figure 18:
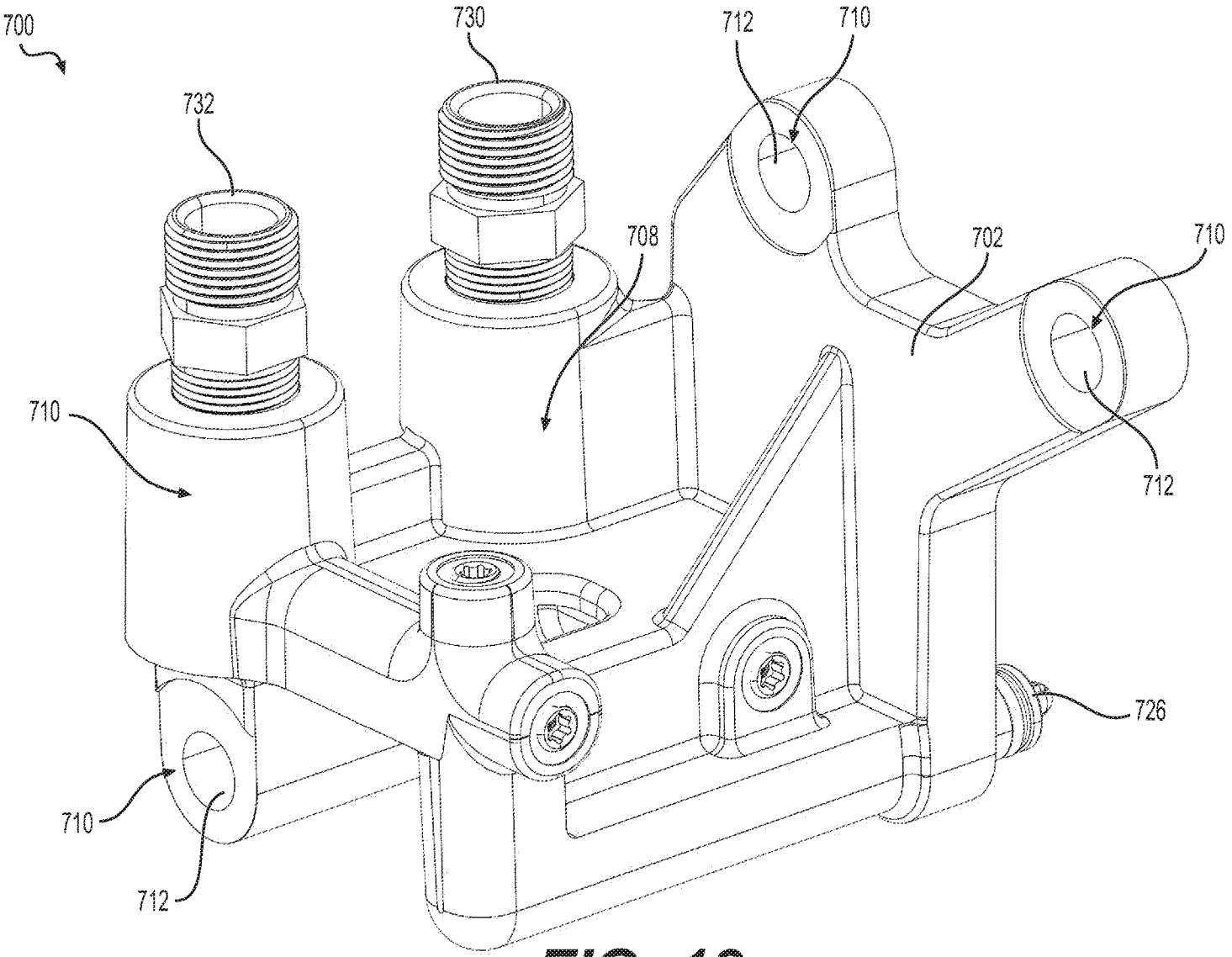
FIG. 18 is a perspective view taken from a front, top, right side of another alternative hydraulic steering component of the stern and swivel bracket assembly of FIG. 5, this hydraulic steering component being a hydraulic connector of a manual helm-actuated steering system.
Figure 19:
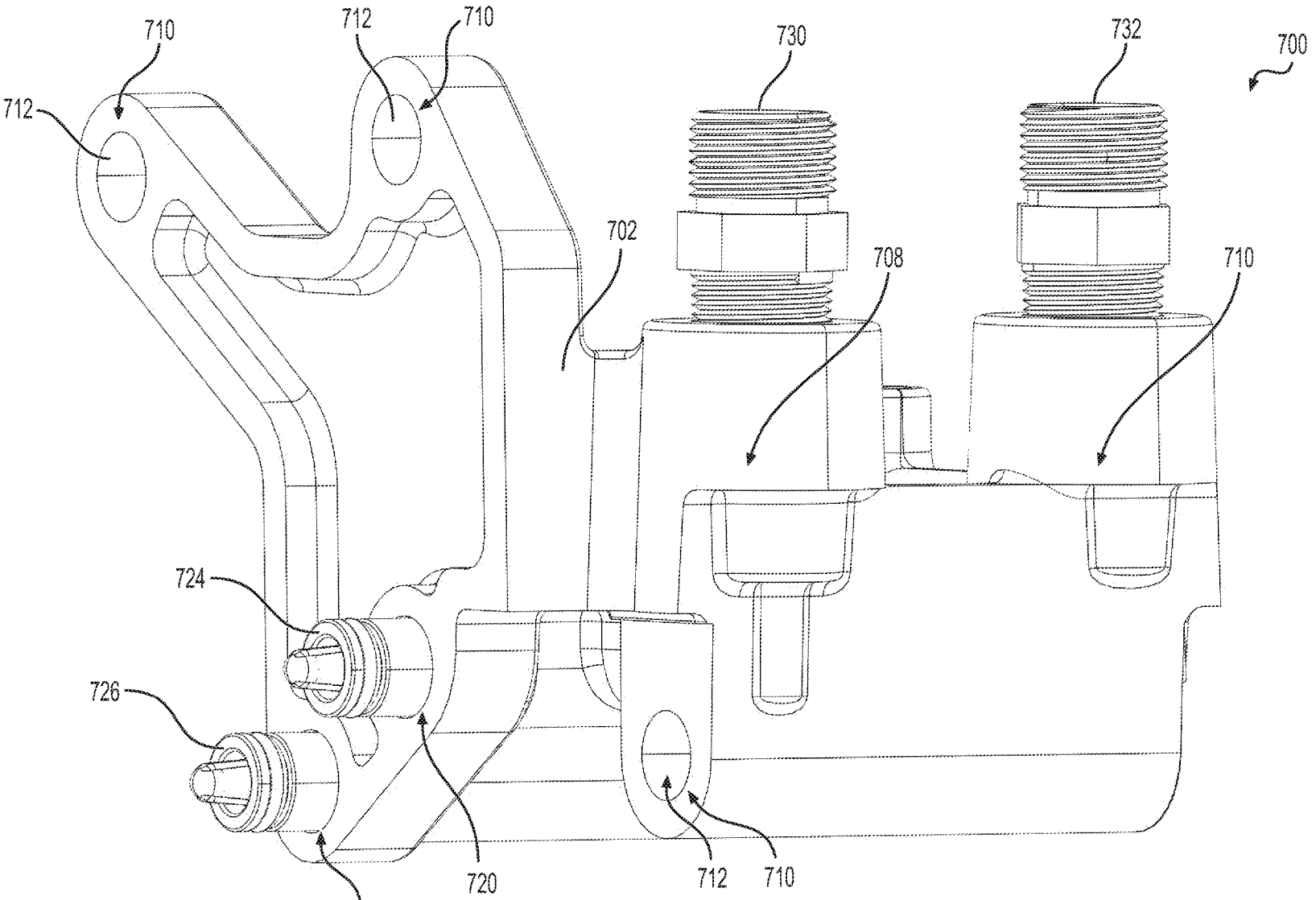
FIG. 19 is a perspective view taken from a rear, top, left side of the hydraulic connector of FIG. 18.

Referring now to FIGS. 18 and 19, another hydraulic steering component that can be used with the stern and swivel bracket assembly 100 instead of the power steering unit 500 described above without having to modify the stern and swivel bracket assembly 100, will be described. The hydraulic steering component that is illustrated in FIGS. 18 and 19 is a hydraulic connector 700 of a manual helm-actuated steering system. The hydraulic connector 700 includes some elements that are the same as or similar to those described with reference to the power steering unit 500. Therefore, for simplicity, elements of the hydraulic connector 700 that are the same as or similar to those of the power steering unit 500 have been labeled with the same reference numerals, but with the first digit of the numeral (i.e. 5) changed to a 7, and will not be described again in detail.

The hydraulic connector 700 has three component mounts 710. Each component mount 710 corresponds to a hole 712 defined in the body 702. The three holes 712 are spaced apart from each other so as to correspond to the bolt pattern 394 of the swivel bracket mounts 390. As such, the hydraulic connector 700 is mountable to the swivel bracket 320 just like the power steering unit 500 through the three fasteners 516. The three fasteners 516 mounting the hydraulic connector 700 to the swivel bracket 320 can have lengths that differ from each other and/or from the lengths illustrated in FIGS. 8 to 10. In addition, the hydraulic connector 700 has hydraulic steer-left and steer-right ports 720, 722 and hydraulic nipples 724, 726 arranged in a similar fashion as in the power steering unit 500.

The hydraulic connector 700 is designed to be used in combination with a manual helm assembly (not shown). Steer-left and steer-right fittings 730, 732 are provided on the body 702. There are no valves in the hydraulic connector 700. Rather, the fitting 730 is fluidly connected to the hydraulic steer-left port 720 via a channel 708 defined within the body 802, and the fitting 732 is fluidly connected to the hydraulic steer-right port 722 via a channel 710 also defined within the body 702.

As in the power steering unit 500, the fittings 730, 732 respectively receive port and starboard hydraulic helm hoses (not shown) that are fluidly connected to the manual helm assembly (not shown). The manual helm assembly includes a hydraulic pump. Turning the helm in one direction actuates the hydraulic pump to pump hydraulic fluid in one direction, and turning the helm in the other direction actuates the hydraulic pump to pump hydraulic fluid in the other direction. Since there is no motor or pump in the hydraulic connector 700, steering inputs from the manual helm assembly displace the hydraulic fluid within the hydraulic steering system and cause upward or downward motion of the piston 334, and thus permit both left and right steering motion of the drive unit 42.

Figure 20:
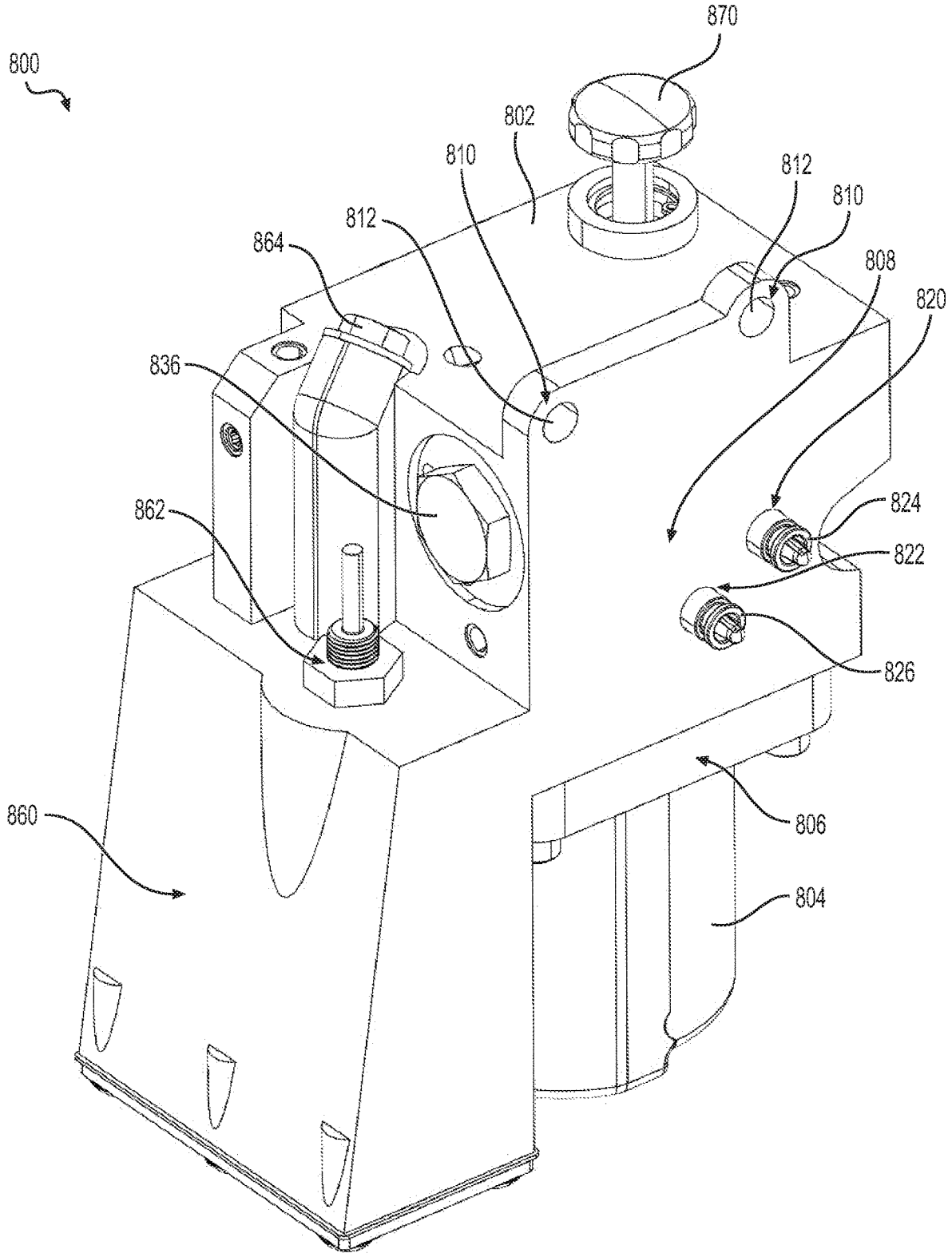
FIG. 20 is a perspective view taken from a front, top, left side of yet another alternative hydraulic steering component of the stern and swivel bracket assembly of FIG. 5, this hydraulic steering component being a power steering unit of a tiller-actuated power steering system.
Figure 21:
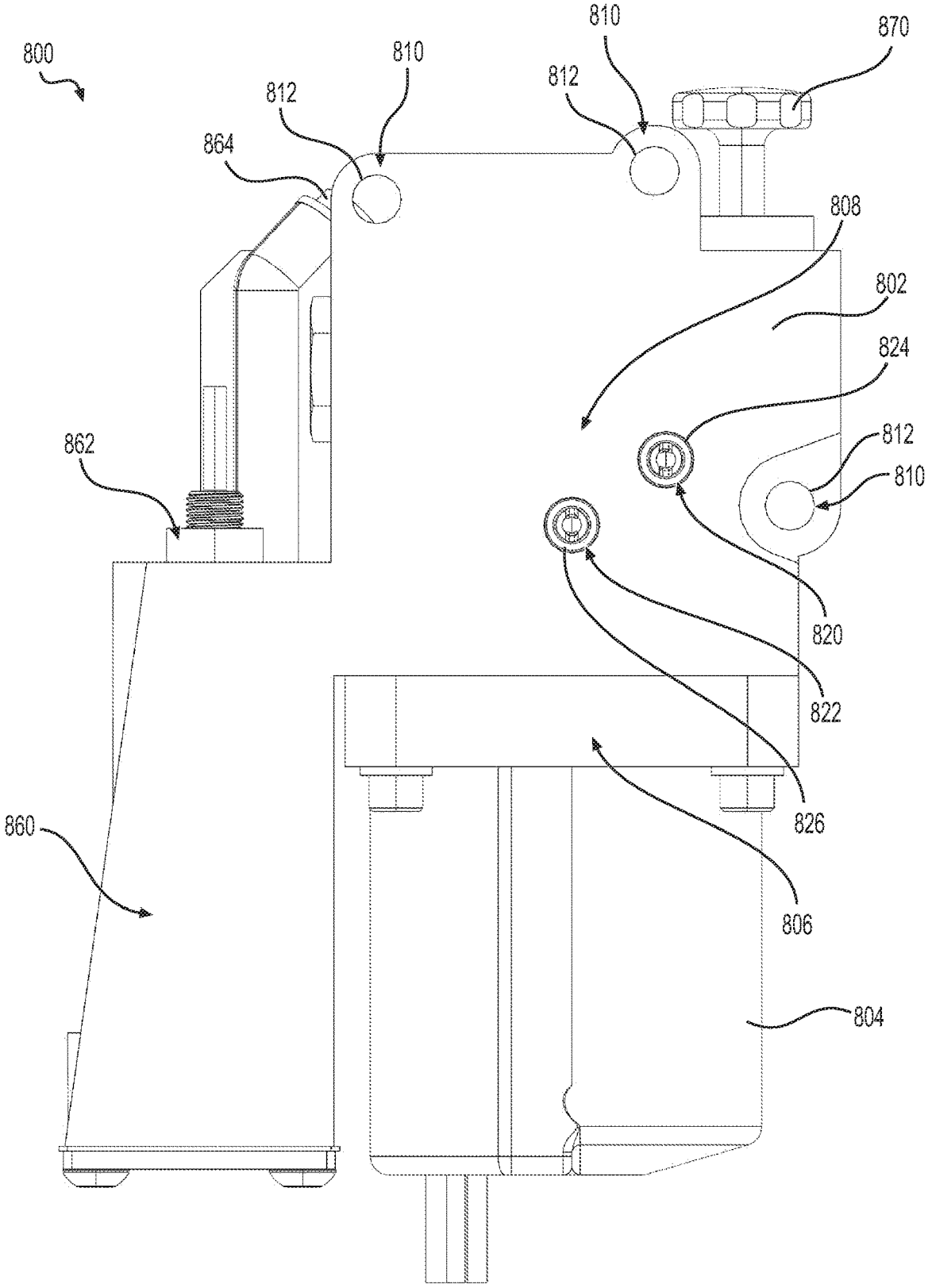
FIG. 21 is a left side elevation view of the power steering unit of FIG. 20.

Referring now to FIGS. 20 and 21, yet another hydraulic steering component that can be used with the stern and swivel bracket assembly 100 instead of the power steering unit 500 described above without having to modify the stern and swivel bracket assembly 100, will be described. The hydraulic steering component that is illustrated in FIGS. 20 and 21 is a power steering unit 800 of a tiller-actuated power steering system. The power steering unit 800 includes elements that are the same as or similar to those described above with reference to the power steering unit 500. Therefore, for simplicity, elements of the power steering unit 800 that are the same as or similar to those of the power steering unit 500 have been labeled with the same reference numerals, but with the first digit of the numeral (i.e. 5) changed to a 8, and will not be described again in detail.

The power steering unit 800 has three component mounts 810. Each component mount 810 corresponds to a hole 812 defined in the body 802. The three holes 812 are spaced apart from each other so as to correspond to the bolt pattern 394 of the swivel bracket mounts 390. As such, the hydraulic steering component 800 is mountable to the swivel bracket 320 just like the power steering unit 500 through the three fasteners 516. The three fasteners 516 mounting the power steering unit 800 to the swivel bracket 320 can have lengths that differ from each other and/or from the lengths illustrated in FIGS. 8 to 10. In addition, the power steering unit 800 has hydraulic steer-left and steer-right ports 820, 822 and hydraulic nipples 824, 826 arranged in a similar fashion as in the power steering unit 500.

The power steering unit 800 is designed to be used in combination with a drive unit 42 having a tiller arm (not shown). Therefore, unlike the power steering units 500, 600, and the hydraulic connector 700, the power steering unit 800 is not actuated via a helm assembly of the watercraft, and therefore does not have fittings to receive port and starboard hydraulic helm hoses.

The body 802 of the power steering unit 800 defines a hydraulic fluid reservoir 860 containing the hydraulic fluid that is required to move the piston 334 within the hydraulic steering actuator 200. The hydraulic fluid reservoir 860 is fluidly connected to the manifold 808 of the power steering unit 800. The manifold 808 is fluidly connected to the pump 806, which is in turn operatively connected to the motor 804. A hydraulic fluid level sensor 862 is fluidly connected to the hydraulic fluid reservoir 860. The hydraulic fluid level sensor 862 is operatively connected to a control unit (not shown) that monitors the hydraulic fluid level within the reservoir 860. A hydraulic fluid inlet 864 is also defined in the body 802 and disposed on top of the power steering unit 800.

The power steering unit 800 further has a manual release valve 870 disposed on top of the body 802. When the manual release valve 870 is in a bypass position, the manual release valve 870 fluidly connects both the hydraulic steer-left and steer-right ports 820, 822 to the manifold 808, and thereby allows the piston 334 to move freely upward and downward in the hydraulic steering actuator 200. This allows the drive unit 42 to steer independent of the operation of the hydraulic steering system. As such, the manual release valve 870 permits the drive unit 42 to be steered freely about the steering axis 204 in the event of a failure of the motor 804 or pump 806 of the power steering unit 800.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A stern and swivel bracket assembly for mounting a drive unit to a watercraft comprising:

a stern bracket having first and second laterally spaced portions;

a swivel bracket pivotally connected to the stern bracket about a tilt-trim axis, the swivel bracket including:

a hydraulic steering actuator located laterally between the first and second portions of the stern bracket when the drive unit is in a trimmed-down position;

the swivel bracket defining first and second hydraulic steer ports facing outward in a first lateral direction, the first and second hydraulic steer ports being fluidly connected to the hydraulic steering actuator through passages formed at least partially within the swivel bracket for supplying hydraulic fluid to the hydraulic steering actuator; and at least one drive unit mounting bracket connected to the hydraulic steering actuator for connecting the drive unit to the swivel bracket, the at least one drive unit mounting bracket being pivotable with respect to the swivel bracket about a steering axis; and a hydraulic linear tilt-trim actuator operatively connected between the stern and swivel brackets, the hydraulic linear tilt-trim actuator being located laterally between the first and second portions of the stern bracket, the hydraulic linear tilt-trim actuator being disposed forward of the hydraulic steering actuator when the drive unit is in the trimmed-down position, the hydraulic linear tilt-trim actuator defining trim-up and trim-down hydraulic ports facing outward in a second lateral direction opposite the first lateral direction.

2. The stern and swivel bracket assembly of claim 1, further comprising a hydraulic tilt-trim pump assembly mounted to the hydraulic linear tilt-trim actuator and located laterally between the first portion of the stern bracket and the hydraulic linear tilt-trim actuator, the hydraulic tilt-trim pump assembly defining trim-up and trim-down hydraulic ports that are fluidly connected to the trim-up and trim-down hydraulic ports of the hydraulic linear tilt-trim actuator for supplying hydraulic fluid to the hydraulic linear tilt-trim actuator.

3. The stern and swivel bracket assembly of claim 2, wherein the hydraulic tilt-trim pump assembly includes a motor, a pump operatively connected to the motor, and a manifold fluidly connected to the pump, and the trim-up and trim-down hydraulic ports of the hydraulic tilt-trim pump assembly are fluidly connected to the manifold.

4. The stern and swivel bracket assembly of claim 1, wherein the hydraulic steering actuator is a rotary steering actuator.

5. The stern and swivel bracket assembly of claim 1, wherein the at least one drive unit mounting bracket includes upper and lower drive unit mounting brackets, and the hydraulic steering actuator extends between the upper and lower drive unit mounting brackets.

6. The stern and swivel bracket assembly of claim 1, wherein the hydraulic steering actuator and the hydraulic linear tilt-trim actuator are laterally aligned when the drive unit is in a trimmed-down position.

7. The stern and swivel bracket assembly of claim 6, wherein the hydraulic steering actuator and the hydraulic linear tilt-trim actuator are laterally aligned along a lateral center of the stern and swivel bracket assembly.

8. The stern and swivel bracket assembly of claim 1, further comprising a hydraulic steering system including a hydraulic steering component mounted to the swivel bracket and being located laterally between the hydraulic linear tilt-trim actuator and the second portion of the stern bracket, the hydraulic steering component defining first and second hydraulic steer ports fluidly connected to the first and second hydraulic steer ports of the swivel bracket for supplying hydraulic fluid to the hydraulic steering actuator.

9. The stern and swivel bracket assembly of claim 8, wherein the hydraulic steering component includes a motor, a pump operatively connected to the motor, and a manifold fluidly connected to the pump, and the first and second hydraulic steer ports of the hydraulic steering component are fluidly connected to the manifold.

10. The stern and swivel bracket assembly of claim 9, wherein the hydraulic steering component further has fittings for receiving port and starboard helm hoses, and the fittings are fluidly connected to the manifold.

11. The stern and swivel bracket assembly of claim 9, wherein the hydraulic steering component further includes a reservoir fluidly connected to the manifold.

12. The stern and swivel bracket assembly of claim 1, wherein the hydraulic steering actuator is at least partially integrally formed with the swivel bracket.

13. A marine outboard engine comprising:

a drive unit; and a stern and swivel bracket assembly for mounting the drive unit to a watercraft comprising:

a stern bracket having first and second laterally spaced portions;

a swivel bracket pivotally connected to the stern bracket about a tilt-trim axis, the drive unit being connected to the swivel bracket, the swivel bracket including:

a hydraulic steering actuator located laterally between the first and second portions of the stern bracket when the drive unit is in a trimmed-down position;

the swivel bracket defining first and second hydraulic steer ports facing outward in a first lateral direction, the first and second hydraulic steer ports being fluidly connected to the hydraulic steering actuator through passages formed at least partially within the swivel bracket for supplying hydraulic fluid to the hydraulic steering actuator; and at least one drive unit mounting bracket connected to the hydraulic steering actuator for connecting the drive unit to the swivel bracket, the at least one drive unit mounting bracket being pivotable with respect to the swivel bracket about a steering axis; and a hydraulic linear tilt-trim actuator operatively connected between the stern and swivel brackets, the hydraulic linear tilt-trim actuator being located laterally between the first and second portions of the stern bracket, the hydraulic linear tilt-trim actuator being disposed forward of the hydraulic steering actuator when the drive unit is in the trimmed-down position, the hydraulic linear tilt-trim actuator defining trim-up and trim-down hydraulic ports facing outward in a second lateral direction opposite the first lateral direction.

14. A watercraft comprising the marine outboard engine of claim 13.

* * * * *